US010391619B2

(12) United States Patent
Smeaton et al.

(10) Patent No.: US 10,391,619 B2
(45) Date of Patent: Aug. 27, 2019

(54) ACCESSORY FOR A FASTENING GUN

(71) Applicant: Quick Grip Staples (HK) Limited, Tsimshatsui Kowloon (HK)

(72) Inventors: Kevin Roy Smeaton, Balmoral (AU); Kevin Graham Doole, Alderley (AU)

(73) Assignee: QUICK GRIP STAPLES (HK) LIMITED, Tsimshatsui, Kowloon (HK)

( * ) Notice: Subject to any disclaimer, the term of this patent is extended or adjusted under 35 U.S.C. 154(b) by 871 days.

(21) Appl. No.: 14/407,524

(22) PCT Filed: Jun. 18, 2013

(86) PCT No.: PCT/AU2013/000641
§ 371 (c)(1),
(2) Date: Dec. 12, 2014

(87) PCT Pub. No.: WO2013/188905
PCT Pub. Date: Dec. 27, 2013

(65) Prior Publication Data

US 2015/0202757 A1 Jul. 23, 2015

(30) Foreign Application Priority Data

Jun. 18, 2012 (AU) ..... 2012902547
Dec. 5, 2012 (AU) ..... 2012905288

(51) Int. Cl.
*B25C 5/16* (2006.01)
*B25C 7/00* (2006.01)
(Continued)

(52) U.S. Cl.
CPC ..... *B25C 5/1637* (2013.01); *B25C 1/005* (2013.01); *B25C 3/004* (2013.01); *B25C 5/00* (2013.01);
(Continued)

(58) Field of Classification Search
CPC .... B25C 7/00; B25C 5/00; B25C 5/16; B25C 5/1637; B25C 5/1696; B25C 5/10;
(Continued)

(56) References Cited

U.S. PATENT DOCUMENTS 1,945,377 A * 1/1934 Posnack ..... B25C 5/0257 227/123
1,987,038 A * 1/1935 Vogel ..... B25C 5/025 227/126
(Continued)

FOREIGN PATENT DOCUMENTS

EP 1033209 A2 9/2000
WO 82/00429 A1 2/1982
WO 1994/0021430 A1 9/1994

OTHER PUBLICATIONS

Extended Supplementary European Search Report cited on corresponding European Application No. 13 80 7315.
(Continued)

*Primary Examiner* — Alexander M Valvis
*Assistant Examiner* — Eduardo R Ferrero
(74) *Attorney, Agent, or Firm* — Caesar Rivise, PC

(57) ABSTRACT

An accessory for a fastening gun includes a magazine assembly with a feed end and a discharge end and configured to support a series of staples in a pre-discharge orientation and with a feed mechanism for feeding the staples from the feed end to the discharge end. A drive member guide assembly is mounted on the magazine assembly and is configured so that a staple drive member can be mounted in the drive member guide assembly and can be driven and retracted along a predetermined path with respect to the magazine assembly, so that, when driven, the drive member can engage a staple to drive legs of the staple into respective components, the drive member guide assembly being con-
(Continued)

figured for mounting on the fastening gun with the drive member connected to a piston or the like of the fastening gun.

18 Claims, 25 Drawing Sheets

(51) Int. Cl.

| | |
|---|---|
| ***B25C 5/10*** | (2006.01) |
| ***B25C 5/00*** | (2006.01) |
| ***B25F 5/02*** | (2006.01) |
| ***B25C 1/00*** | (2006.01) |
| ***B25C 3/00*** | (2006.01) |
| *B25C 5/06* | (2006.01) |

(52) U.S. Cl.
CPC ..... *B25C 5/10* (2013.01); *B25C 7/00* (2013.01); *B25F 5/026* (2013.01); *B25C 3/008* (2013.01); *B25C 5/06* (2013.01); *B25C 5/16* (2013.01); *B25C 5/1665* (2013.01); *B25C 5/1668* (2013.01)

(58) Field of Classification Search
CPC ..... B25C 5/1665; B25C 5/1668; B25C 3/004; B25C 3/008; B25C 5/06; B65C 3/004; B65C 3/008
See application file for complete search history.

(56) References Cited

U.S. PATENT DOCUMENTS 2,087,779 A * 7/1937 Pankonin ..... B25C 5/0207 227/134
2,351,045 A 6/1944 Heller
2,380,655 A 7/1945 Lang
2,437,039 A * 3/1948 Peterson ..... B25C 5/10 173/124
2,489,050 A * 11/1949 Ruskin ..... B25C 5/0207 227/128
2,691,778 A * 10/1954 Lester ..... B25C 5/0242 227/128
2,733,440 A * 2/1956 Jenny ..... B25C 5/06 227/123
2,775,764 A * 1/1957 Maynard ..... B25C 5/0257 227/123
2,857,596 A * 10/1958 Allen ..... B25C 1/04 227/123
2,873,447 A * 2/1959 Catlin ..... B25C 1/18 227/10
3,266,138 A 8/1966 Tipper
3,601,300 A * 8/1971 Anstett ..... B25C 1/044 227/130
3,610,505 A * 10/1971 Males ..... B25C 5/10 227/127
3,633,811 A * 1/1972 Ploen ..... B25C 5/1651 227/109
3,856,139 A * 12/1974 Black ..... B25C 1/005 206/340
3,862,712 A * 1/1975 LaPointe ..... B25C 5/10 227/120
3,934,778 A * 1/1976 Males ..... B25C 5/1665 227/123
4,126,260 A * 11/1978 Mickelsson ..... B25C 5/10 227/132
4,327,858 A 5/1982 Powers
4,380,312 A 4/1983 Landrus
4,485,952 A 12/1984 Weis
4,552,296 A * 11/1985 Sheng ..... B25C 5/06 227/109
4,574,992 A 3/1986 Holman
4,795,073 A * 1/1989 Yamamoto ..... B25C 5/1696 227/120
5,009,356 A * 4/1991 Chang ..... B25C 5/1637 227/120
5,360,305 A 11/1994 Kerrigan
5,524,807 A * 6/1996 Bullard ..... B25C 1/001 227/109
5,628,445 A * 5/1997 Braddock ..... B25C 7/00 227/120
5,695,108 A * 12/1997 Lee ..... B25C 5/1644 227/109
5,813,588 A * 9/1998 Lin ..... B25C 1/005 227/109
5,846,019 A 12/1998 Kuhns
5,941,652 A 8/1999 Kuhns
6,394,332 B2 * 5/2002 Akiba ..... B25C 1/008 227/130
6,481,612 B1 * 11/2002 Mangone, Jr. ..... B25C 5/00 227/130
6,659,700 B1 12/2003 Farrell et al.
6,769,193 B1 * 8/2004 Meisner ..... B25C 7/00 227/107
7,290,693 B2 * 11/2007 Cheng ..... B25C 5/06 227/29
7,356,972 B2 4/2008 Leek et al.
8,042,717 B2 * 10/2011 Lam ..... B25C 1/008 227/120
2002/0100787 A1 * 8/2002 Lin ..... B25C 1/003 227/8
2003/0024962 A1 * 2/2003 Sims ..... B25C 7/00 227/148
2003/0066860 A1 4/2003 Yoshiyuki et al.
2003/0071103 A1 4/2003 Yoshiyuki et al.
2003/0071104 A1 4/2003 Yoshiyuki et al.
2003/0115738 A1 * 6/2003 Barlow ..... B25C 5/00 29/592
2003/0192932 A1 * 10/2003 Lat ..... B25C 5/00 227/123
2003/0218044 A1 * 11/2003 Laubach ..... B25C 1/005 227/109
2004/0084501 A1 * 5/2004 Lin ..... B25C 1/005 227/120
2005/0223498 A1 * 10/2005 Kirby ..... B25C 5/0214 7/160
2005/0242152 A1 11/2005 Ronconi
2006/0011695 A1 1/2006 Ishizawa et al.
2006/0071047 A1 4/2006 Aguirre et al.
2006/0124684 A1 6/2006 Schell et al.
2006/0201993 A1 * 9/2006 Hur ..... A61B 17/115 227/179.1
2006/0273131 A1 12/2006 Chen
2007/0095876 A1 5/2007 Oda et al.
2007/0199969 A1 * 8/2007 Pozzato ..... B25C 5/06 227/8
2007/0215665 A1 * 9/2007 Ohmori ..... B25C 1/047 227/8
2008/0067213 A1 3/2008 Shima et al.
2008/0179371 A1 * 7/2008 Gardner ..... B25C 5/15 227/1
2008/0185417 A1 8/2008 Brendel et al.
2008/0197165 A1 * 8/2008 Chen ..... B25C 1/008 227/8
2008/0223898 A1 * 9/2008 Rouger ..... B25C 1/08 227/8
2009/0039135 A1 * 2/2009 Kubo ..... B25C 7/00 227/120
2009/0072002 A1 3/2009 Ishizawa et al.
2009/0194573 A1 8/2009 Liang et al.
2009/0194574 A1 8/2009 Shima et al.
2009/0236386 A1 * 9/2009 Wang ..... B25C 7/00 227/8
2011/0094847 A1 4/2011 Hirabayashi

OTHER PUBLICATIONS

Ponnampalam, Ponnam; International Search Report and Written Opinion of the International Searching Authority, issued in Inter-

(56) References Cited

OTHER PUBLICATIONS national Application No. PCT/AU2013/000641; dated Aug. 16, 2013; 7 pages.

* cited by examiner

ACCESSORY FOR A FASTENING GUN

FIELD

Various exemplary embodiments of an accessory for a fastening gun are described in this specification. The fastening gun is of the type used for driving fasteners into components that are to be connected together.

SUMMARY

Various exemplary embodiments of an accessory for a fastening gun comprise a magazine assembly with a feed end and a discharge end and configured to support a series of staples in a pre-discharge orientation and with a feed mechanism for feeding the staples from the feed end to the discharge end; and a drive member guide assembly mounted on the magazine assembly and configured so that a staple drive member can be mounted in the drive member guide assembly and can be driven and retracted along a predetermined path with respect to the magazine assembly, so that, when driven, the drive member can engage a staple to drive legs of the staple into respective components, the drive member guide assembly being configured for mounting on the fastening gun with the drive member connected to a piston or the like of the fastening gun.

The drive member guide assembly may be configured to cooperate with a staple drive member having a head that is configured to bear against a crown of the staple and a shank that can be connected to a piston or the like of the fastening gun.

The magazine assembly may include an elongate outer guide member that defines a pair of sidewalls and a floor interposed between the sidewalls. An inner guide member may be positioned on the floor between the sidewalls such that the guide members define a pair of outer channels and a central channel interposed between the outer channels.

A pair of roof members may be arranged on respective sidewalls of the outer guide member and may extend inwardly from the sidewalls to cover the outer channels at least partially. Each roof member may define a recess or cut-out at or near a feed end of the guide assembly so that staples can be fed into the assembly via the recesses.

Discharge ends of the inner and outer guide members may be located in a common plane that is angled towards the feed end from the floor. An angle between the common plane and the floor may be selected according to a required application.

The feed mechanism may include a tension block mounted in the outer and central channels. The tension block may define outer bearers received in respective outer channels and having bearing faces that are configured to bear against respective legs of the last staple in a row of the staples. The outer bearers may be configured so that the bearing faces are oriented in a plane generally parallel to said common place of the discharge ends of the inner and outer guide members.

The tension block may include a cross member that interconnects the bearers to span the central channel. The cross member may define a central bearing face that is recessed with respect to the bearing faces and oriented in a plane generally parallel to said common plane of the discharge ends of the inner and outer guide members. In use, the central bearing face may bear against the crown of a staple.

The tension block may be spring mounted in the guide assembly to be biased towards the discharge ends of the inner and outer guide members. A reel or a roll of a length of spring steel may be mounted rotatably on the tension block. One end of the length may be fastened to the floor at the discharge ends so that when the tension block is withdrawn to a pre-release condition, the length of steel is largely unrolled, with an arcuate transverse profile of the length serving to bias the length into a rolled up condition.

A catch assembly may be mounted on the guide assembly to engage the tension block in a releasable manner when the tension block is in a pre-release condition.

Various exemplary embodiments of the accessory for a fastening gun may include the drive member.

The drive member may define a pair of opposed generally flat surfaces. The drive member may have a head with a crown-engaging surface and a shank extending from the head so that the drive member has a generally T-shaped appearance. The drive member may have a locator positioned at each end of the crown-engaging surface to locate the crown of the staple with respect to the crown engaging surface.

The crown engaging surface may have a curved or arcuate transverse profile that corresponds generally with a transverse profile of the crown of the staples.

The drive member may include a connector fixed to a distal end of the shank so that the drive member can be connected to a piston of the fastening gun. The connector may be generally cylindrical and threaded so that it can be screwed into the piston. The drive member may be of a one-piece construction.

The guide assembly may include a guide plate that is fastened to the outer guide member. The guide plate may define a recess at a discharge end that is profiled to correspond with an external profile of the outer guide member.

The guide assembly may include a cover plate that is fastened to the guide plate. An inner surface of the cover plate and the guide plate may define an internal passage in which the head of the drive member can be displaced towards and away from a workpiece. The cover plate and the guide plate may be configured so that the internal passage also defines a guide path for the staples, once they are fed from the staple guide assembly.

The accessory may include an adapter so that the drive member guide assembly can be connected to the fastening gun. The adapter may include an adapter plate that can be fastened to a mounting plate of the gun. The adapter may also include a locating formation that is configured to nest with a complementary formation defined by the driver blade guide assembly.

The accessory may include a safety pin assembly that is arranged with respect to the drive member guide assembly to be linearly displaceable with respect thereto. The safety pin assembly may include a safety pin that is configured to be displaceable between an extended position in which a portion of the safety pin extends beyond a distal end of the drive member guide assembly and a retracted position.

The safety pin assembly may include a safety connector that is capable of connection to both the safety pin and a safety mechanism of the fastening gun. The safety pin and the safety connector may be configured so that when the safety pin moves from the extended position into the retracted position, the safety mechanism of the fastening gun is disengaged and the gun can fire.

The magazine assembly may include a base that is configured for bearing against a workpiece as the fastening gun is operated. A guide arrangement may be positioned or arranged on the base and configured to guide the base against the workpiece such that the trajectory of a fastener ejected from the magazine and driven into the workpiece from one side of the workpiece is displaced from the trajectory of a fastener driven into the workpiece from an opposite side so that interference of the fasteners is inhibited.

The guide arrangement may be in the form of a pair of pins that extends from the base. The pins may be positioned so that the workpiece can be received between the pins. The pins may be adjustable so that they can be positioned offset with respect to each other about a longitudinal axis of the base. Alternatively, the pins may have a diameter which is sufficient to provide non-symmetrical orientation of the magazine with respect to the workpiece on opposite sides of the workpiece There is also described various exemplary embodiments of a fastening gun that includes the above accessory.

Various exemplary embodiments of a magazine assembly for a fastening gun include a floor or base that is configured for bearing against a workpiece as the fastening gun is operated and a guide arrangement positioned on the base and configured to guide the base against the workpiece such that the trajectory of a fastener ejected from the magazine and driven into the workpiece from one side of the workpiece is displaced from the trajectory of a fastener driven into the workpiece from an opposite side so that interference of the fasteners is inhibited.

The guide arrangement may be in the form of a pair of pins that extends from the base. The pins may be positioned so that the workpiece can be received between the pins. The pins may be adjustable so that they can be positioned offset with respect to each other about a longitudinal axis of the base. Alternatively, the pins may have a diameter which is sufficient to provide non-symmetrical orientation of the magazine with respect to the workpiece on opposite sides of the workpiece.

DESCRIPTION OF THE DRAWINGS

FIG. 9(*a*) shows a further view of the discharge end, with the tension block released.

FIG. 10(*a*) shows detail of a row of staples engaged with the tension block.

DESCRIPTION OF THE EMBODIMENTS

Figure 1:
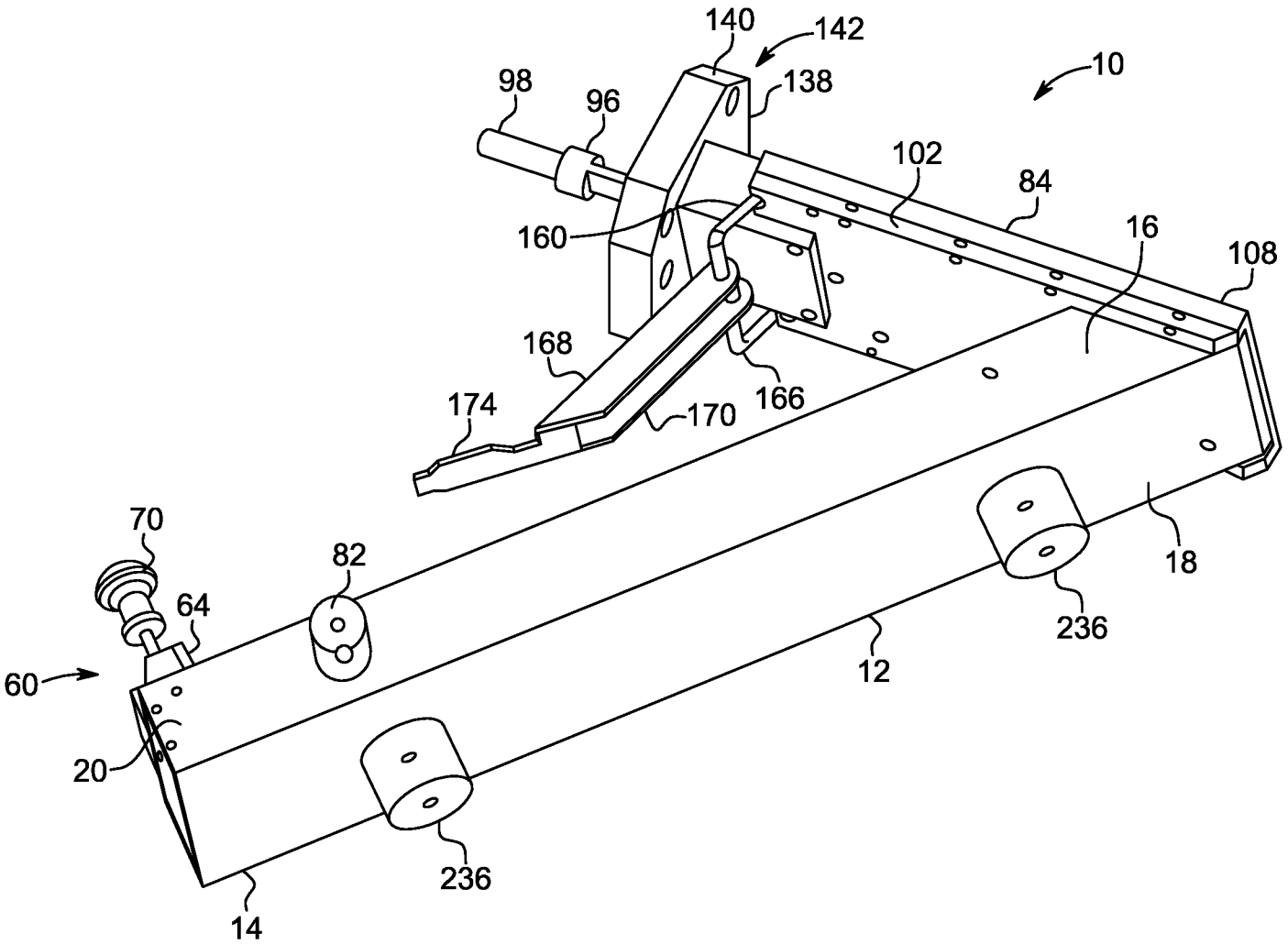
FIG. 1 shows a three-dimensional view, from one side and from below, of an exemplary embodiment of an accessory for a fastening gun.

In FIGS. 1 to 4 of the drawings, reference numeral 10 generally indicates an exemplary embodiment of an accessory for a fastening gun.

The accessory 10 is configured for use with a fastening gun of the type that can drive a piston towards a workpiece and then subsequently retract the piston. Usually, the piston is connected to some form of drive member which is guided into engagement with a fastener stored in a magazine. These guns are often referred to as nail or staple guns.

The accessory 10 is configured to allow such a fastening gun to be used to drive staples 34 (FIG. 9) into timber. In this description, the staples in question are of sufficient strength to retain, for example, a pair of truss members together. As such, they comprise a crown portion or crown 38 and a leg 36 extending from each end of the crown 38. They can be formed by bending steel of a suitable tensile strength into the desired shape. One example of such a staple has legs 36 that incorporate an inward bend or angle. Thus, when the legs 36 are driven into respective components that are to be fastened together, the nature of the material serves to enhance connection of the components. Furthermore, withdrawal or loosening of the staple is inhibited. In one example, a diameter of a staple wire can vary from 2 mm to 6 mm. Also, the staples can vary from 20 mm to 150 mm in width. This demonstrates the size of the staples that can be driven into a workpiece with the accessory 10 in combination with a suitable fastening gun.

The accessory 10 includes a staple feed assembly in the form of a magazine assembly or magazine 12. The magazine 12 includes an elongate staple guide assembly 14. Detail of the staple guide assembly 14 can be seen in FIGS. 14 to 17.

The staple guide assembly 14 includes an outer guide member 20 that defines a pair of sidewalls 16 and a floor 18 interposed between the sidewalls 16. An inner guide member 22 is positioned on the floor 18 between the sidewalls 16. The inner guide member 22 also has a floor 24 that is positioned on the floor 18 with sidewalls 26 extending from the floor 24 so that the guide assembly 14 defines a pair of outer channels 28 and a central channel 30 interposed between the outer channels 28.

The floor 18 defines a pair of longitudinally extending slots 19. The floor 24 defines a pair of corresponding, longitudinal ribs or ridges 21. The slots 19 and the ridges 21 have complementary cross sectional shapes so that the ridges 21 that can slide into the slots 19. The shapes of the slots 19 and the ridges 21 are such that the inner and outer guide members 20, 21 are inhibited from lateral displacement with respect to each other.

The magazine 12 can have a length that is suited for a particular application. For example, joists and rafters are often spaced at about 400 mm. The magazine 12 can thus have a length of about 390 mm to fit between the joists and the rafters.

Figure 13:
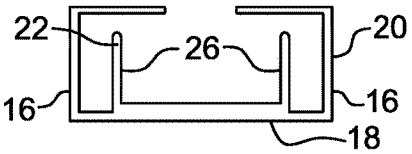
FIG. 13 shows an end view of the staple guide of FIG. 12.
Figure 15:
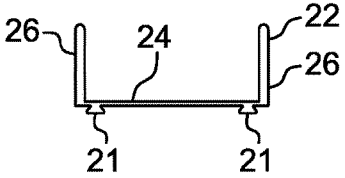
FIG. 15 shows an end view of an exemplary embodiment of an inner guide member of the magazine assembly.
Figure 16:
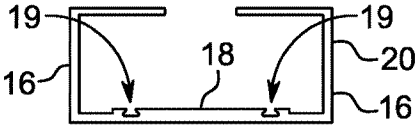
FIG. 16 shows an end view of the outer guide member of FIG. 14.
Figure 17:
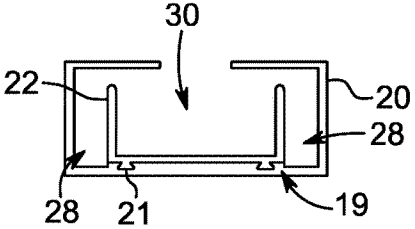
FIG. 17 shows an end view of an exemplary embodiment of a staple guide of the magazine assembly, incorporating the outer and inner guide members of FIGS. 14 and 15, respectively.
Figure 12:
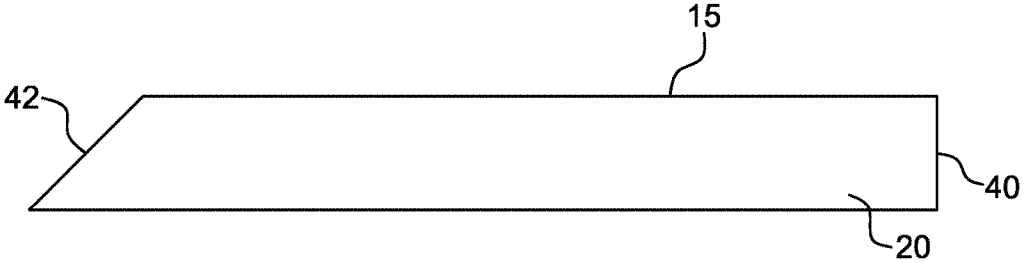
FIG. 12 shows a side view of an exemplary embodiment of a staple guide of the magazine assembly.
Figure 14:
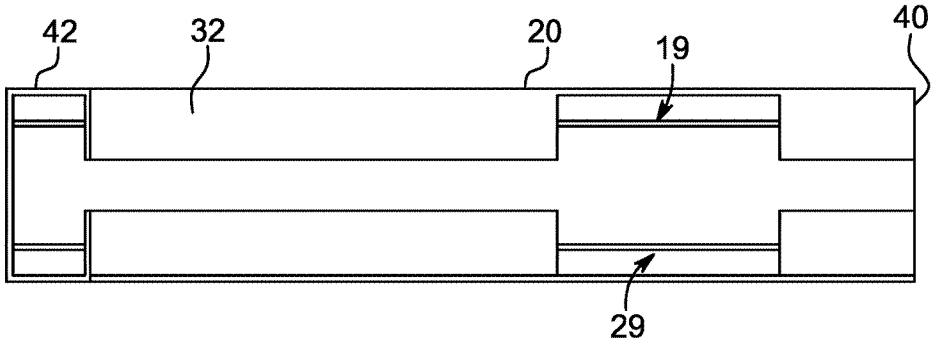
FIG. 14 shows a plan view of an exemplary embodiment of an outer guide member of the magazine assembly.
Figure 18:
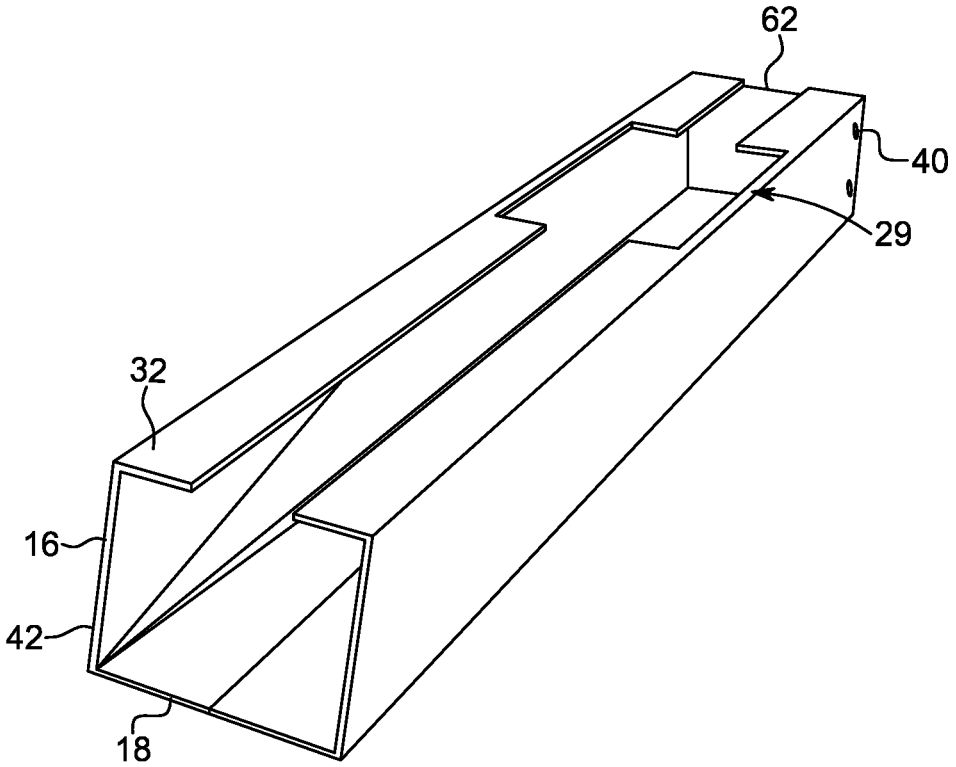
FIG. 18 shows a three-dimensional view of the outer guide member incorporating a mounting block for the catch assembly of FIG. 8.

The inner and outer guide members 22, 20 can take different forms and can be fabricated in different ways. For example, instead of a guide assembly 14, the inner and outer guide members 22, 20 can be in the form of an extrusion to define a unitary structure in the form of a staple guide 15. In that case, the relevant mould can be configured so that the extrusion defines a common floor and two pairs of sidewalls 16, 26. An example of such an extrusion is shown in FIGS. 12 and 13. For convenience, the same reference numerals are used as in FIGS. 14 to 17. However, in this case, the floor 18 is taken between the inner guide members 22.

The guide assembly 14 or staple guide 15 includes a pair of roof members 32. The roof members 32 are arranged on the sidewalls 16 and extend inwardly from the sidewalls 16 to cover the outer channels 28. The roof members 32 define cut-outs or recesses 29 at or near a feed end 40 of the assembly 14. Staples 34 can be fed into the assembly 14 via the recesses 29.

Discharge ends 42 of the inner and outer guide members 22, 20 are located in a common plane that is angled towards the feed end 40 from the floor 18. The angle between the common plane and the floor 18 is about 45°. However, the angle can vary, for example, between about 40° and 90°, depending on the required application. In this example, the angle is about 45°. For example, truss and frame fabricators would likely require a 90° angle. Many nail guns have magazine angles that are measured from a horizontal plane and not from a vertical plane. It is to be understood that the above measurements are taken between said common plane and the floor 18 as opposed to an external reference. Thus, if the angle mentioned above is 20° (quite common in nail guns), it would be 20° if the floor 18 is in a horizontal plane. However, it can also be understood to be 70° with respect to a vertical plane.

Figure 7:
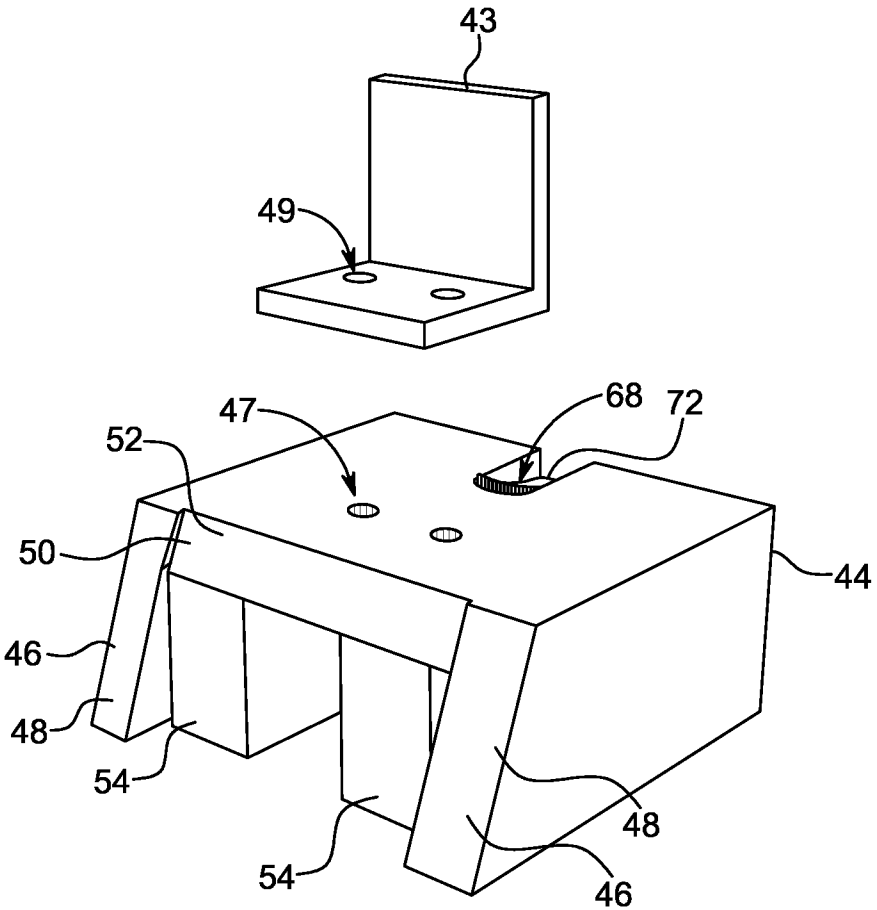
FIG. 7 shows an exemplary embodiment of a tension block for the accessory.

The guide assembly 14 includes a tension block 44 that is mounted in the channels 28, 30 to slide between the feed and discharge ends 40, 42, respectively. The tension block 44 is shown in some detail in FIG. 7.

The tension block 44 has a pair of outer bearers 46 that define bearing faces 48 configured to bear against respective legs 36 of the last staple in a row of the staples 34. The outer bearers 46 are received in respective outer channels 28. In that condition, the bearing faces 48 are oriented in a plane generally parallel to said common plane of the discharge ends 42 of the inner and outer guide members 22, 20.

A cross member 50 interconnects the bearers 46 to span the central channel 30. The cross member 50 defines a central bearing face 52 that is slightly recessed with respect to the bearing faces 48. The central bearing face 52 is oriented in a plane generally parallel to said common plane of the discharge ends of the inner and outer guide members 22, 20.

A pair of internal guides 54 depends from the cross member 50 and is received in the central channel 30.

Figure 2:
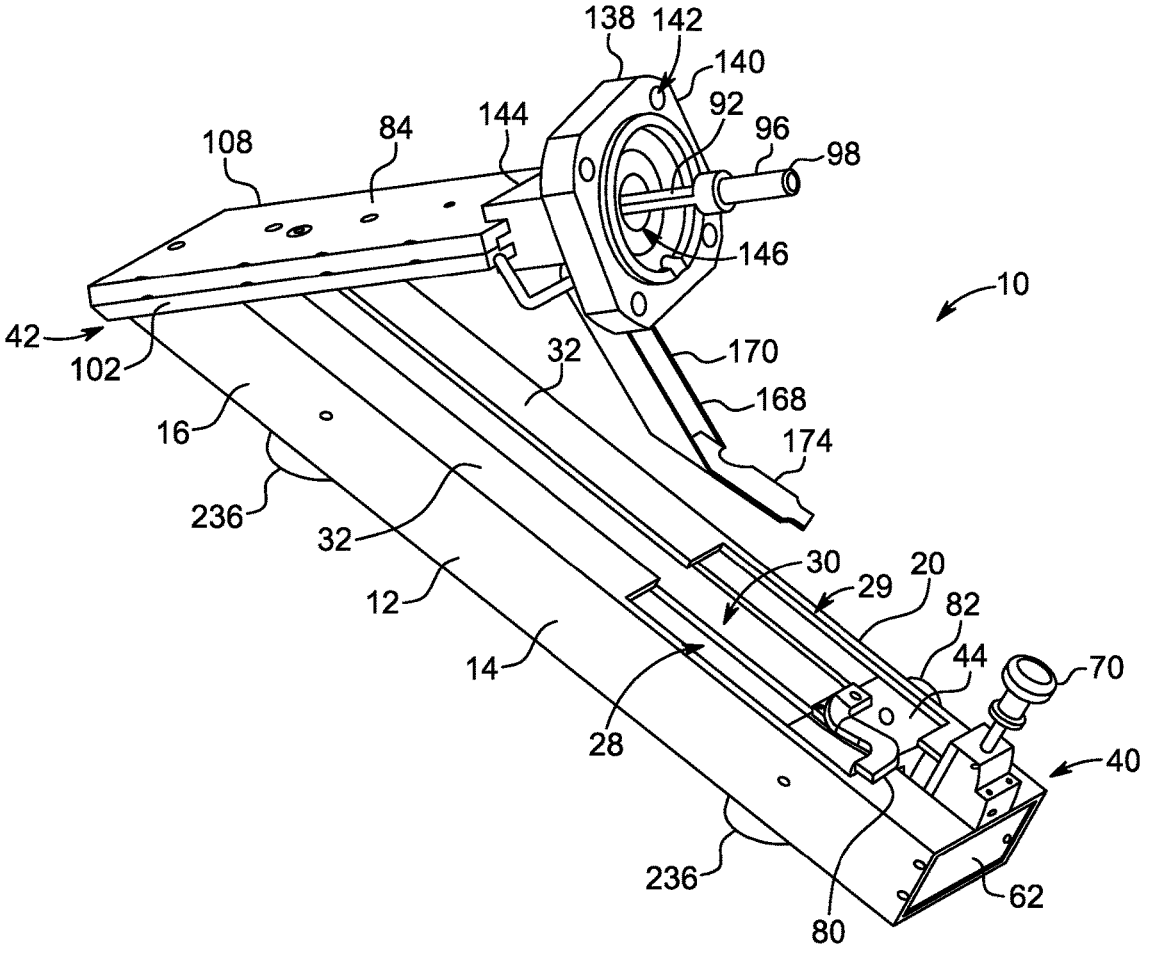
FIG. 2 shows a three-dimensional view, from above and behind, of the accessory.
Figure 3:
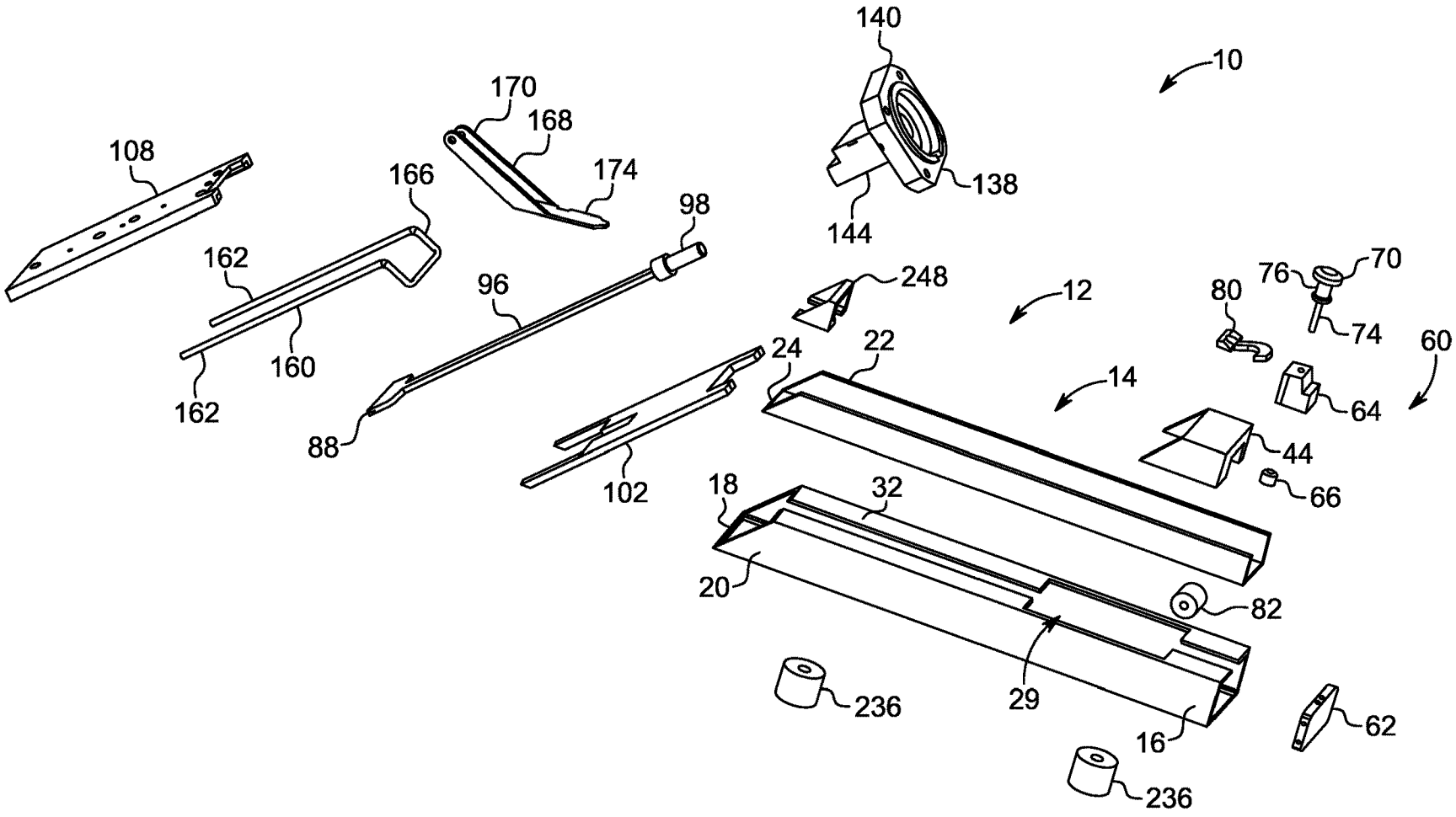
FIG. 3 shows an exploded rear view of the accessory.
Figure 4:
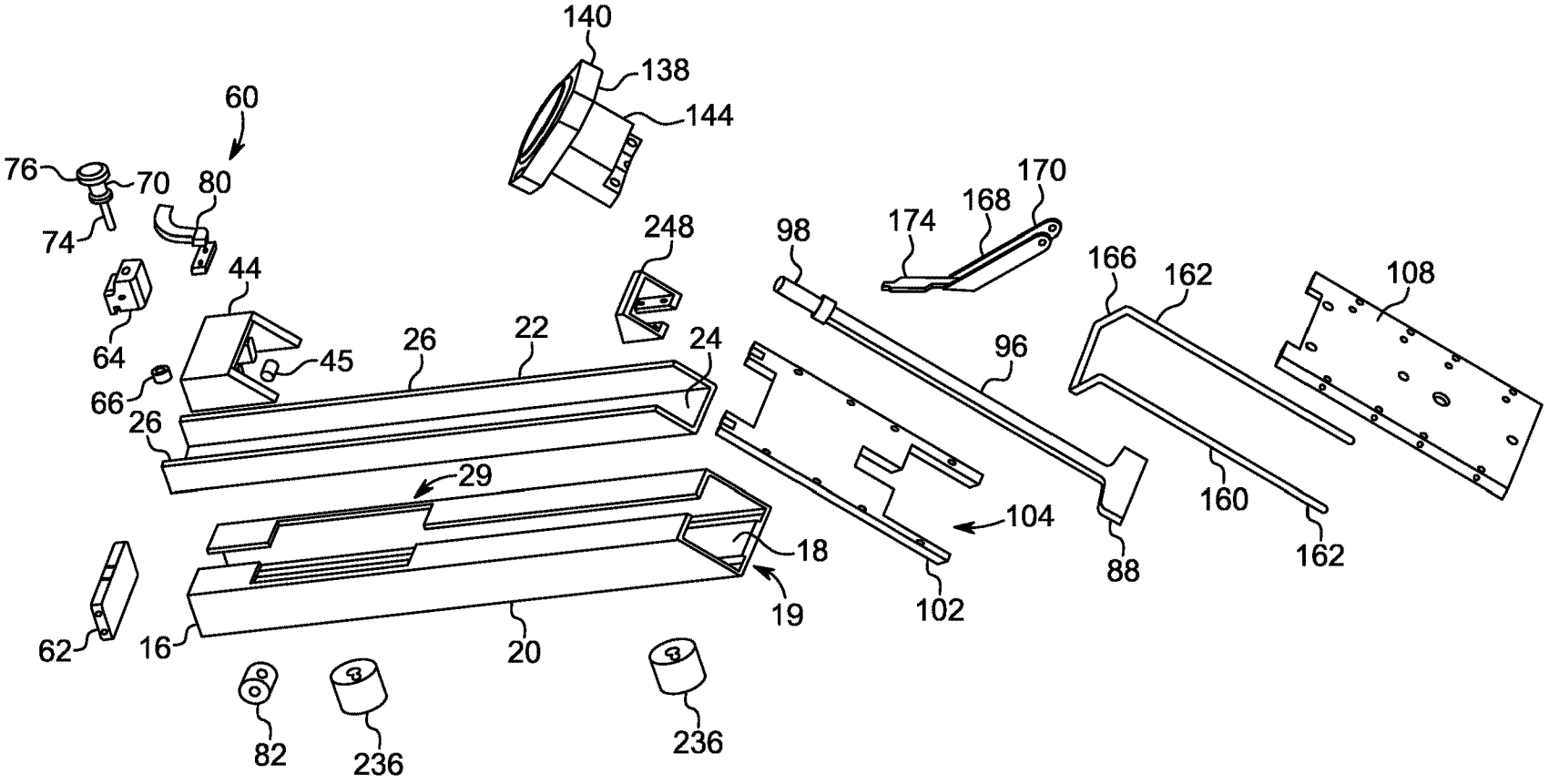
FIG. 4 shows an exploded front view of the accessory.
Figure 9:
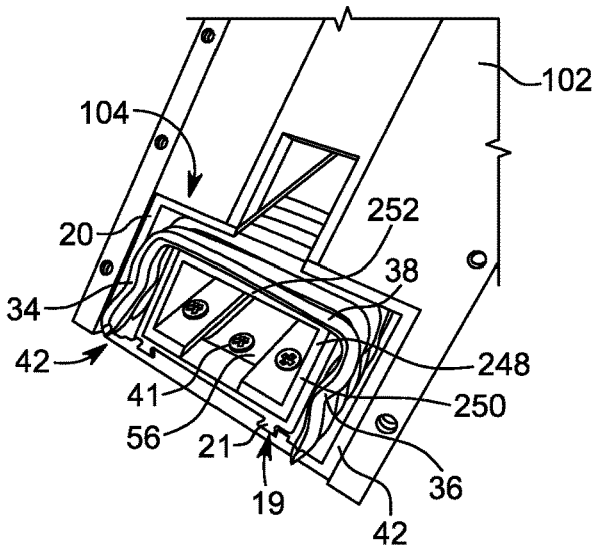
FIG. 9 shows a discharge end of the magazine assembly and an exemplary embodiment of a guide plate arranged on the discharge end, with staples.
Figure 10:
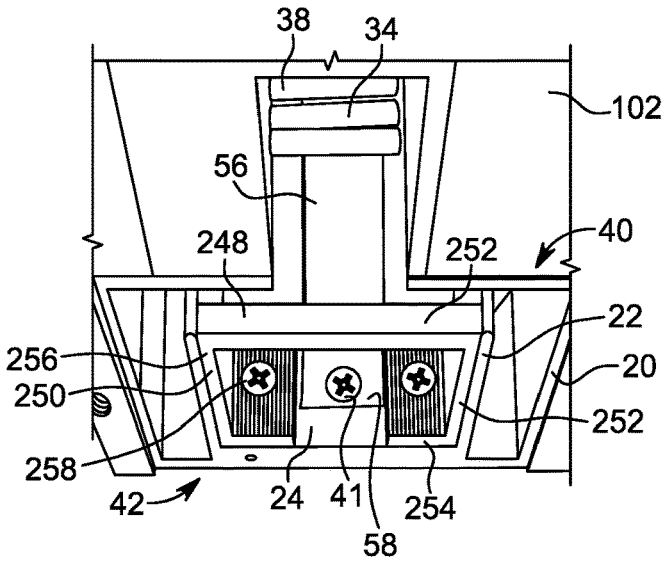
FIG. 10 shows a discharge end of the magazine assembly and the guide plate.

The tension block 44 is spring mounted in the guide assembly 14 to be biased towards the discharge end 42. For example, the tension block 44 includes a reel or a roll of a length of spring steel 56. One end 58 is fastened to the floor 24 at the discharge end 42 with a fastener such as a screw 41 (FIGS. 9 and 10). When the tension block 44 is withdrawn to its pre-release condition, for example, as shown in FIGS. 1 and 2, the length of steel is largely unrolled. The length of spring steel 56 has an arcuate transverse profile that serves to bias the length into a rolled up condition. It follows that retention of the tension block 44 in the pre-release condition is against the bias of the length of spring steel 56. The tension block 44 is also shown in a pre-release condition in FIGS. 5 and 6.

The length of spring steel 56 is rolled and unrolled on and off a roller or reel 45 (FIG. 10(*a*)) rotatably mounted on the tension block 44.

It follows that the tension block 44 and the length of spring steel 56 together define part of a feed mechanism for feeding for staples 34 from the feed end to the discharge end of the guide assembly 14.

A catch assembly 60 is mounted on the guide assembly 14 to engage the tension block 44 in a releasable manner when the tension block 44 is in a pre-release condition.

Figure 6:
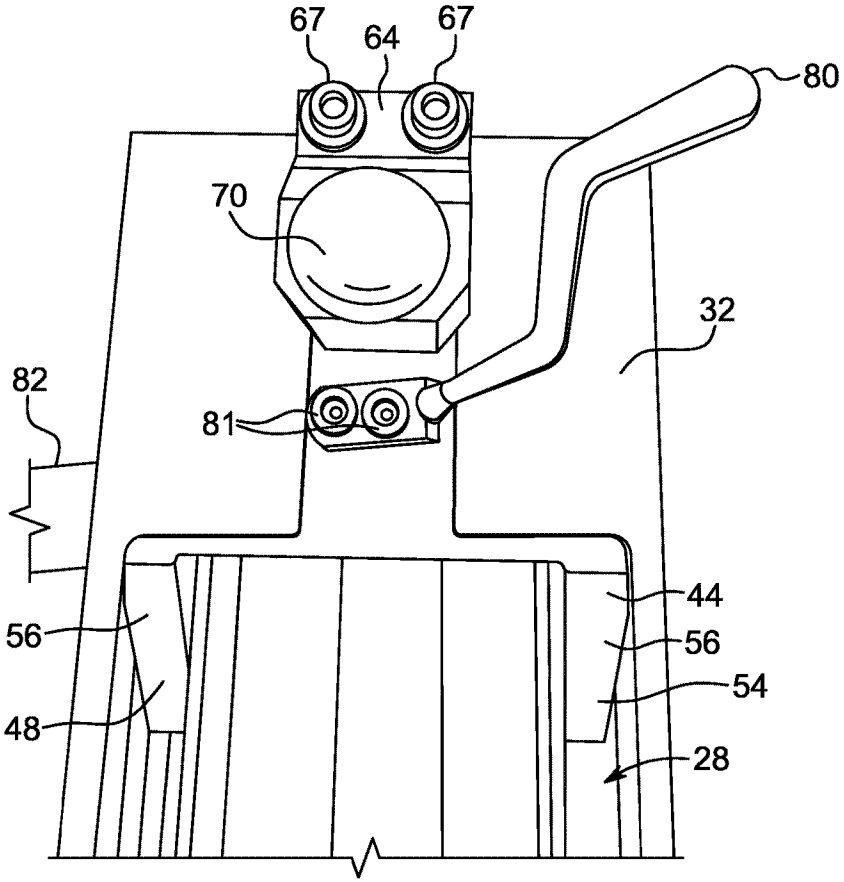
FIG. 6 shows a further view of the feed end of the magazine assembly.
Figure 19:
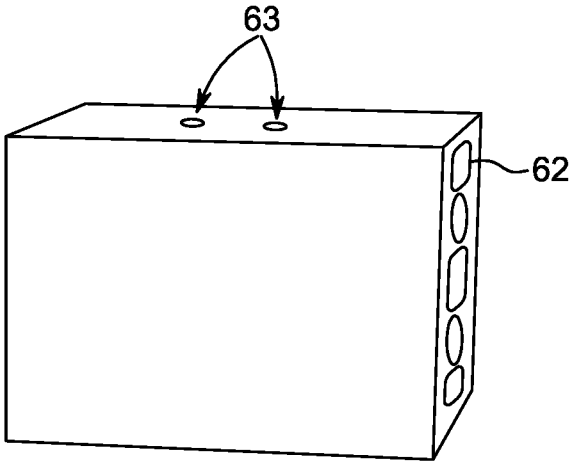
FIG. 19 shows a three-dimensional view of the mounting block in FIG. 18.
Figure 21:
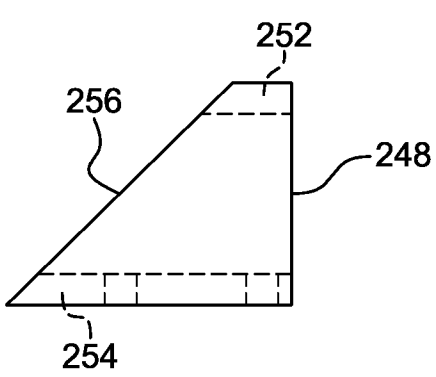
FIG. 21 shows a side view of the staple guide protection member.
Figure 20:
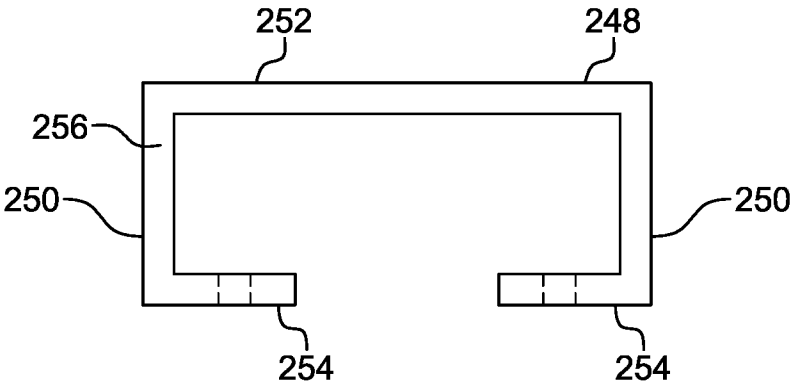
FIG. 20 shows an end view of an exemplary embodiment of a staple guide protection member for the accessory.
Figure 23:
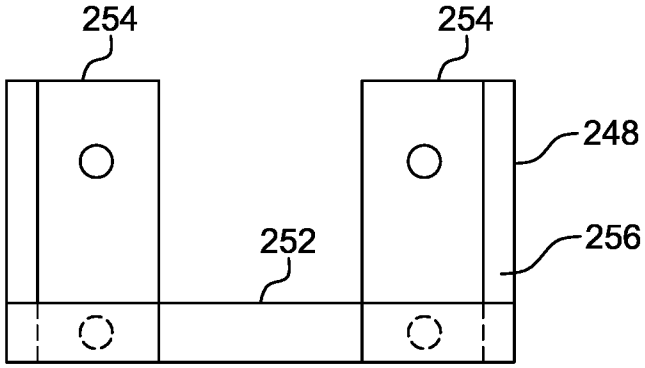
FIG. 23 shows a plan view from above of the staple guide protection member.
Figure 22:
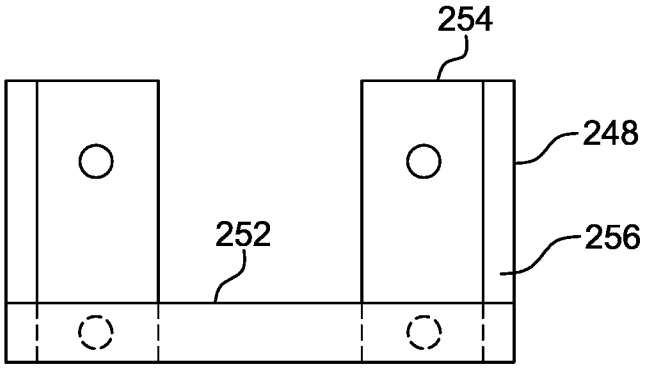
FIG. 22 shows a plan view from below of the staple guide protection member.

The catch assembly 60 includes a catch block 64. The catch block 64 extends along and over the central channel 30. A mounting block 62 is mounted between the sidewalls 16 at the feed end 40 of the assembly 14. The mounting block 62 defines a pair of threaded holes 63 (FIG. 19). The catch block 64 defines a pair of corresponding passages 65 so that the catch block 64 can be fastened to the mounting block 62 with suitable fasteners 67 (FIG. 6).

A catch 66 is mounted on the catch block 64 and is displaceable relative thereto between an inoperative and an operative position. The tension block 44 defines a catch recess 68 in which the catch 66 can be received when the tension block 44 is in the pre-release condition or position. The catch assembly 60 includes a finger pull handle 70 that is fastened to the catch 66 so that a user can move the catch 66 from the operative to the inoperative position. The catch 66 can be biased into the operative position. Thus, the catch 66 can be spring mounted on the catch block 64. Furthermore, the tension block 44 can be shaped to define a ramp 72 that extends from a feed end to the recess 68. The catch 66 can be generally cylindrical with a rounded end. The catch 66 and the ramp 72 are positioned so that when the tension block 44 is drawn towards the feed end, or cocked, the catch 66 engages the ramp 72 and is urged upwardly against its bias until it is urged into the recess 68.

Figure 8:
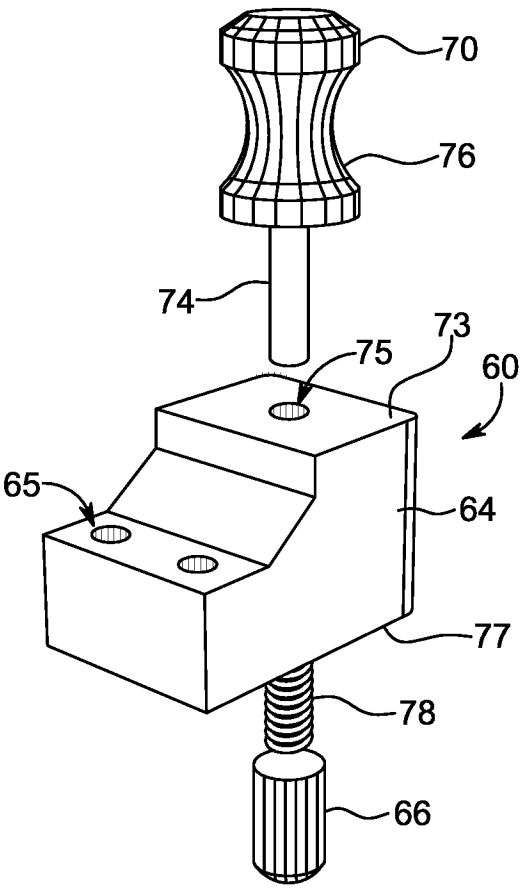
FIG. 8 shows an exploded view of an exemplary embodiment of a catch assembly for engaging the tension block in a releasable manner.

The handle 70 comprises a shank 74. A gripping formation or arrangement 76 is positioned on the shank 74. The catch block 64 defines a passage 75 extending between a handle side 73 and a catch side 77 of the block 64 (FIG. 8). The shank 74 extends into the passage 75 and is fastened to the catch 66. A spring 78 is received in the catch block 64 to engage the catch 66 and the catch block 64 to provide the necessary bias. Thus, when the tension block 44 is retained in its pre-release condition, a user can grip the handle 70 to displace the catch 66 into its inoperative position to release the tension block 44. When the tension block 44 is drawn back into its pre-release condition, the catch 66 can assume its operative condition in the recess 68, in an automatic manner, to retain the tension block 44 in the pre-release condition.

In one example, a handle mount 43 can serve to mount a tension block handle to the cross member 50 to extend beyond respective sidewalls 16. The tension block 44 can define a pair of threaded holes 47 that corresponds with a pair of openings 49 in the mount 43. Thus, the handle can be fastened to the tension block 44 with suitable fasteners. A user can use the handle to draw the tension block 44 back into its pre-release condition.

Figure 5:
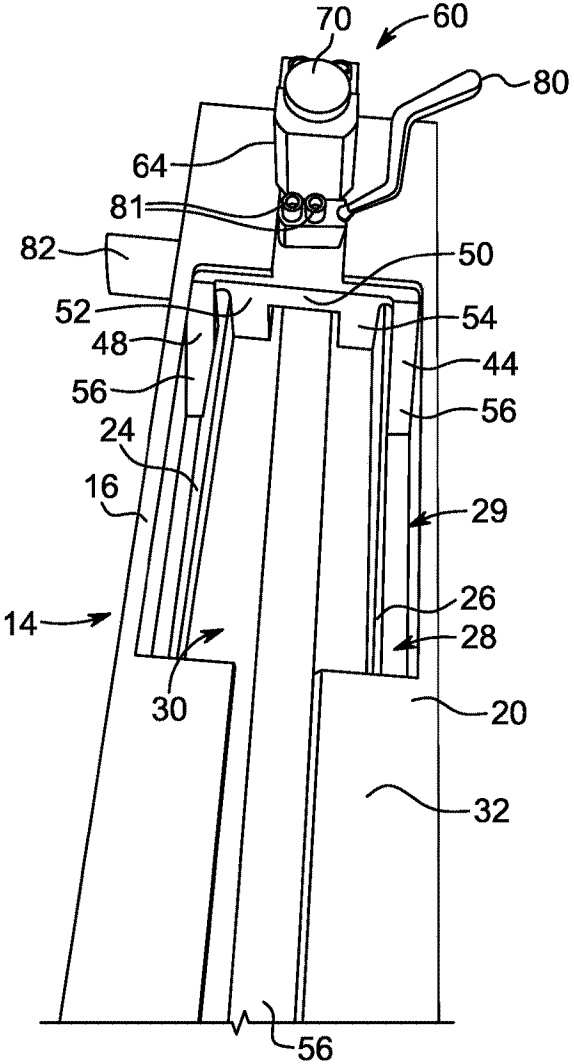
FIG. 5 shows a feed end of an exemplary embodiment of a magazine assembly for the accessory.

A tension block handle 80 is fastened to the tension block 44 with a pair of threaded fasteners 81, as shown in FIGS. 5 and 6. A user can use the handle 82 to draw the tension block 44 back into its pre-release condition with one hand. A handle formation 82 extends from one of the sidewalls 16 and is oppositely oriented relative to the handle 80 so that a user can hold the accessory 10 in a stable condition while withdrawing the tension block 44.

The accessory 10 includes a drive member guide assembly 84. The drive member guide assembly 84 is configured to guide a drive member 86 when the drive member is driven into engagement with a staple 34 fed from the magazine 12.

As set out below, the drive member 86 can have a number of different shapes and configurations. However, in various exemplary embodiments, the drive member 86 is formed from a flat sheet of steel so that the drive member 86 has a pair of opposed flat surfaces. Further, in various exemplary embodiments, the drive member 86 has a head 88 with a crown-engaging surface 90 and a shank 92 extending from the head 88 so that the drive member 86 has a generally T-shaped appearance (FIGS. 35 to 45).

A locator 94 is positioned at each end of the surface 90 to locate the crown 38 of the staple 34 with respect to the crown engaging surface 90. The surface 90 has a curved or arcuate transverse profile that corresponds generally with a transverse profile of the crown 38 of the staples 34. This facilitates pickup of the staple 34 as the drive member 86 is driven towards the workpiece.

Figure 35:
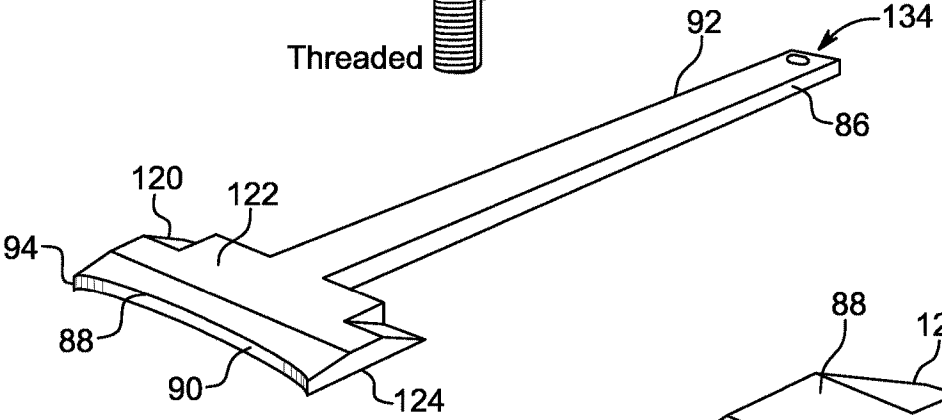
FIG. 35 shows a three-dimensional view of an exemplary embodiment of a drive member for use with the accessory.
Figure 36:
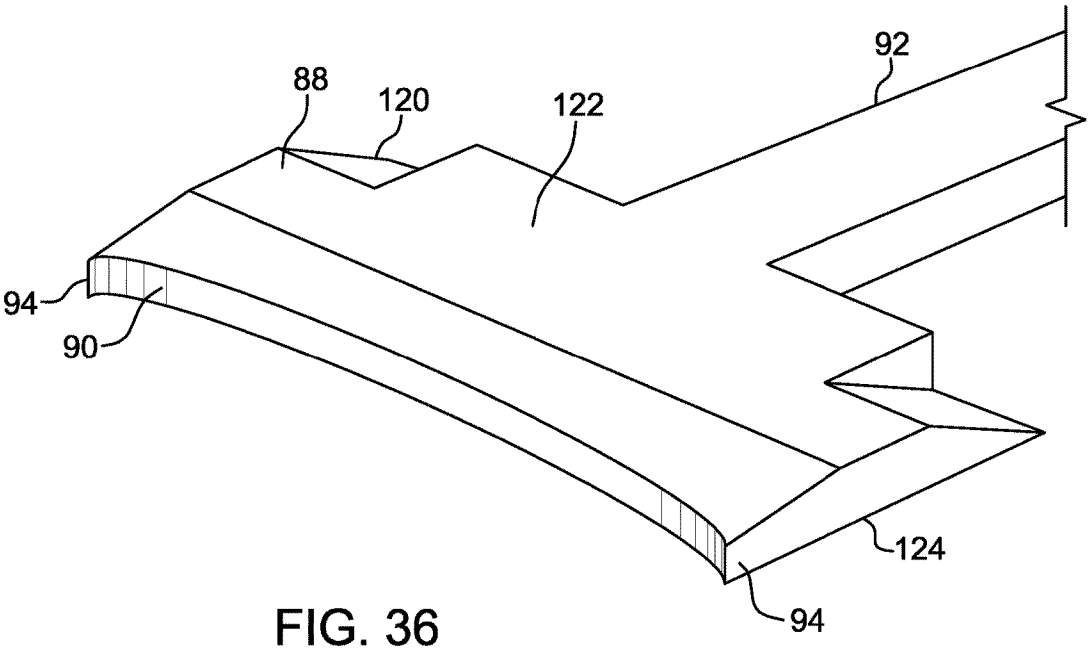
FIG. 36 shows a three-dimensional view of an exemplary embodiment of a head of any of the drive members described in the specification.
Figure 37:
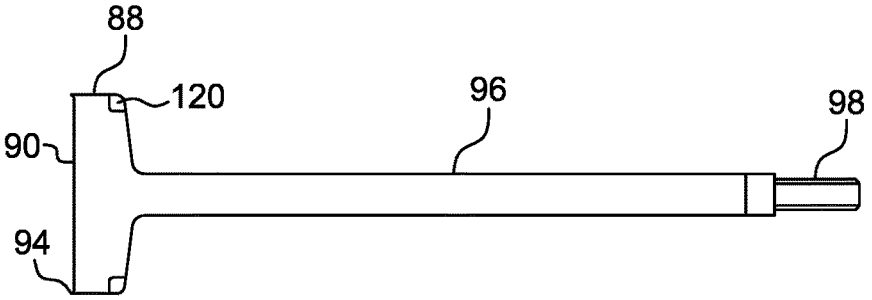
FIG. 37 shows a plan view of an exemplary embodiment of a drive member for use with the accessory.
Figure 38:
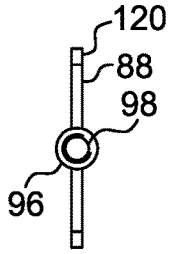
FIG. 38 shows an end view of the drive member of FIG. 37.

An exemplary embodiment of a drive member 96 is shown in FIGS. 37 to 38. With reference to FIGS. 35 and 36, like reference numerals refer to like parts, unless otherwise specified. In this example, the drive member 96 is of a one-piece construction with a connector 98 fixed to a distal end of the shank 92. The connector 98 is generally cylindrical and threaded so that it can be screwed into a piston of the fastening gun.

Figure 39:
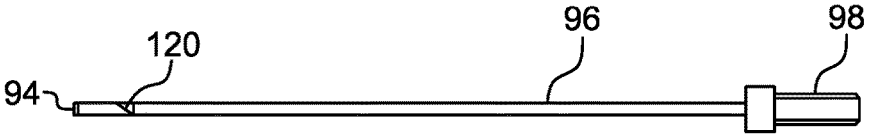
FIG. 39 shows a side view of the drive member of FIG. 37.
Figure 40:
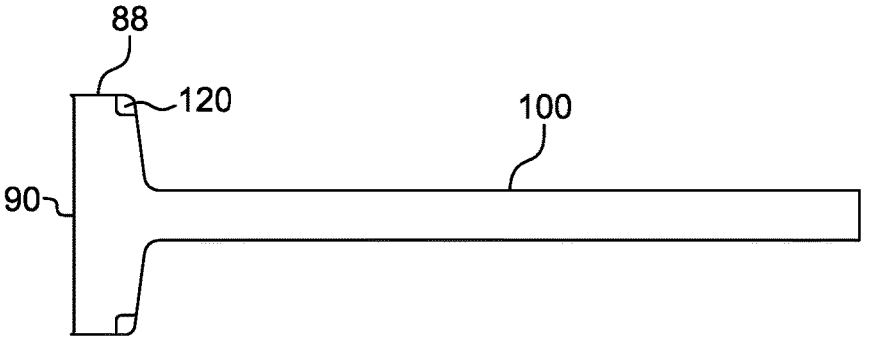
FIG. 40 shows a plan view of an exemplary embodiment of a drive member for use with the accessory.
Figure 41:
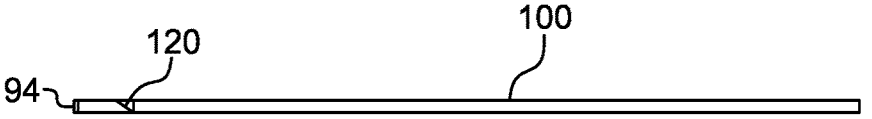
FIG. 41 shows a side view of the drive member of FIG. 40.

A further exemplary embodiment of a drive member 100 is shown in FIGS. 40 and 41. With reference to FIGS. 35 to 39, like reference numerals refer to like parts, unless otherwise specified. In this example, the shank 92 incorporates a connector as part of the flat sheet of steel referred to above.

The guide assembly 84 has a guide plate 102 that is fastened to the outer guide member 20. The guide plate 102 defines a recess 104 at a discharge end that is profiled to correspond with an external profile of the outer guide member 20. Detail of the guide plate 102 can be seen in FIGS. 29 and 30. A distal end of the plate 102 is bevelled at 106 to be coplanar with the floor 18 of the outer guide member 20. The guide plate 102 can be welded to the guide member 20.

The angle between the guide plate 102 and the floor 18 is about 45°. However, the angle can vary, for example, between about 40° and 90°. It follows that the drive member guide assembly 84 and the magazine 12 are oriented at these angles with respect to each other.

A cover plate 108 is fastened to the guide plate 102. An inner surface 110 of the cover plate 108 defines a pair of external walls 112 and a pair of internal walls 114. The walls 112, 114, together with the guide plate 102 define an internal passage 116 in which the head 88 of the drive member can be displaced towards and away from a workpiece. Thus, the passage 116 also defines a guide path for the staples 34, once they are fed from the staple guide assembly 14 into a striking position. Details of the cover plate 108 can be seen in FIGS. 24 to 28.

The walls 112, 114 together with the guide plate 102 define a pair of external passages 118. The purpose of these passages 106 is described below.

The cover plate 108 is dimensioned to cover both the guide plate 102 and the discharge end 42 of the assembly 14. The walls 112, 114 are dimensioned so that a space or gap between the guide plate 102 and the cover plate 108 corresponds generally with a thickness of a staple 34. Thus, a foremost staple 34 can be received in the space or gap prior to being driven into a workpiece by the drive member as the drive member is driven towards the workpiece.

The cover plate 108 is fastened to the guide plate 102 with releasable fasteners. This enables the cover plate 108 to be removed from the guide plate 102 for servicing and clearing of the passage 116. Also, the fact that the cover plate 108 can be removed allows spare parts to be supplied using larger numbers of smaller components to extend the life of the accessory 10.

The cover plate 108 includes or defines viewing apertures 117 so that an operator can check for any problems within the internal passage 116.

As mentioned previously, the drive member can take a number of different configurations. However, the drive member does have common features, shown in FIG. 36. These include an upper edge of the head 88 which is partially bevelled at 120. The bevel extends from a surface 122 that is directed towards the staple guide assembly 14, in use, to an opposed surface 124. The bevelled areas 120 are in general alignment with the legs 36 of the staples 34. This inhibits obstruction or interference between the head 88 and the staples 34, once a staple has been driven into the workpiece and the drive member is retracted.

Figure 34:
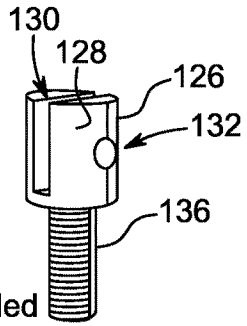
FIG. 34 shows an exemplary embodiment of a connector for connecting a staple drive member to a piston of the fastening gun.

The accessory 10 can include a connector 126 (FIG. 34) for connecting the shank 92 of the drive member to a piston (not shown) of the gun. The connector 126 includes a cylindrical head 128 that defines a diametric slot 130. A passage 132 extends through the head 128, transversely with respect to the slot 130. A free end of the shank 92 can be received in the slot 130. An opening 134 is defined in the shank 92 and is positioned so that when the free end of the shank 92 is received in the slot 130, the opening 134 is aligned with the passage 132. Thus, the shank 92 can be pinned to the head 128 with a suitable pivot pin or the like received through the passage 132 and the opening 134.

Figure 31:
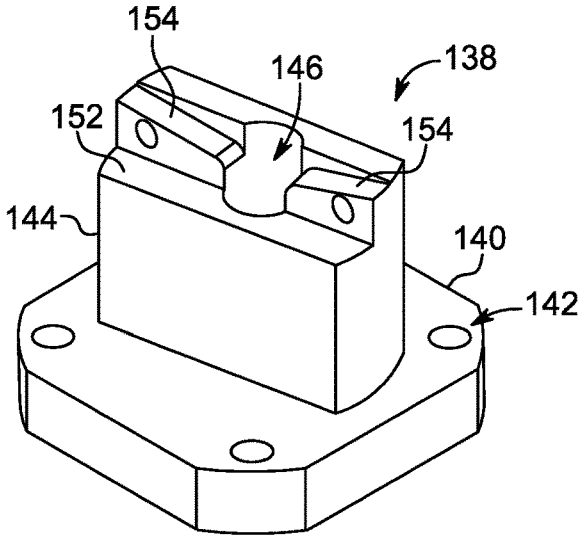
FIG. 31 shows an exemplary embodiment of an adapter for the accessory for facilitating connection of the accessory to a fastening gun.

A threaded shank 136 extends from the head 128. The shank 136 can be threaded into the end of a piston of the gun. The threaded shank 136 can be of a suitable length so that a stroke length of the drive member can be adjusted depending on the extent to which the shank 136 is threaded into the piston of the gun The accessory 10 includes an adapter 138 (FIG. 31) so that the drive member guide assembly 84 can be connected to the gun. The adapter 138 includes an adapter plate 140 that can be fastened to a mounting plate of the gun with fasteners received through openings 142. A locating formation 144 extends from the adapter plate 140.

The locating formation 144 and the adapter plate 140 define a passage 146. The shank 92 extends through the passage 146 to engage the piston, as described above.

Figure 29:
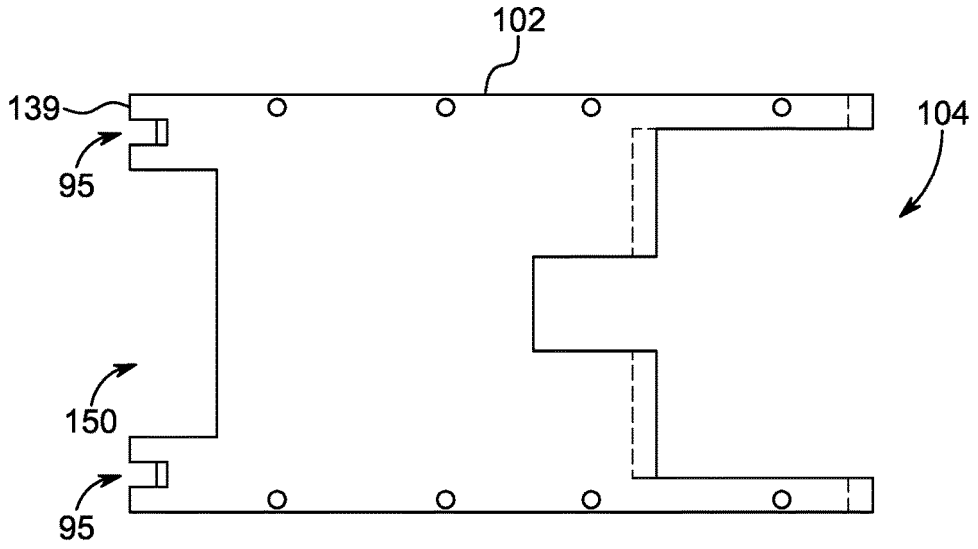
FIG. 29 shows a plan view of an exemplary embodiment of a guide plate of the drive member guide.
Figure 30:
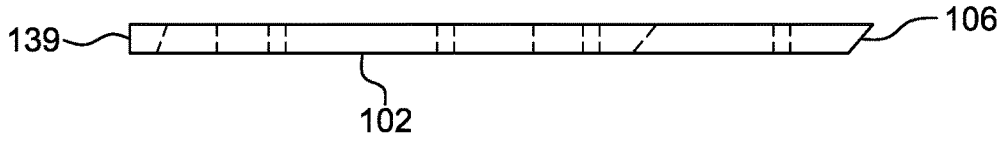
FIG. 30 shows a side view of the guide plate of FIG. 29.

A proximal end 139 of the guide plate 102 defines a recess 150 to receive the locating formation 144 (FIG. 29). Thus, the locating formation 144 defines a shoulder 152 that can abut the assembly 84 in the recess 150. The locating formation 144 also defines a pair of opposed ledges 154. The ledges 154 are positioned on opposite sides of the passage 146 and are configured and oriented to bear against proximal sides of the head 88. Thus, the adapter 138 can serve to inhibit excessive retraction of the drive member.

An extent of retraction can also be governed by a rubber or elastomeric bush or stopper arrangement 156 (FIG. 49, for example) above a piston 194 to which the drive member is attached. The ledges 154 are positioned and the bush 156 is configured so that there is clearance between the head 88 of the drive member 86 and the ledges 154. Also, the bush 156 can absorb any impact and thus inhibit damage to the adaptor 138 or drive member.

Figure 24:
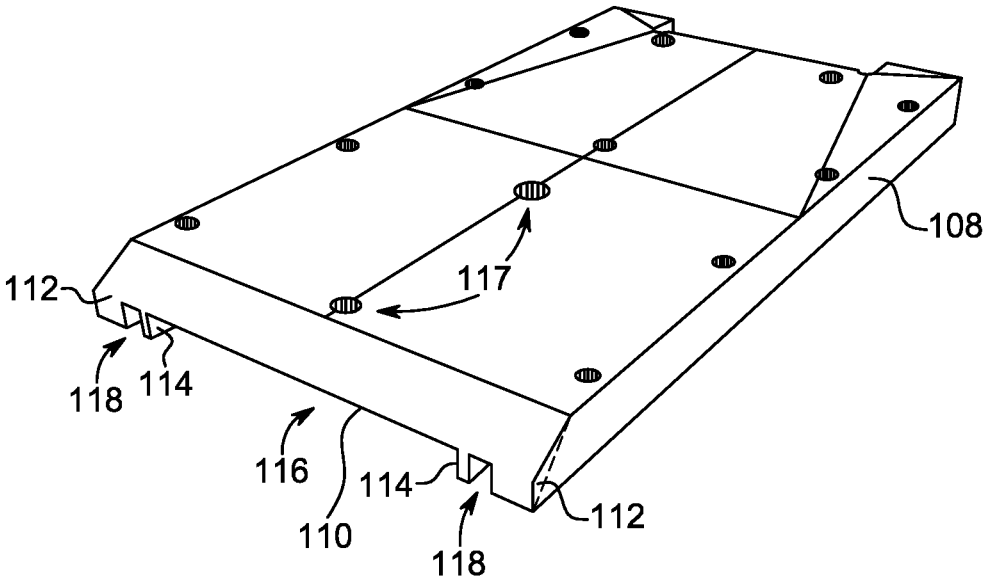
FIG. 24 shows a three-dimensional view of an exemplary embodiment of a cover plate of a drive member guide for the accessory.
Figure 25:
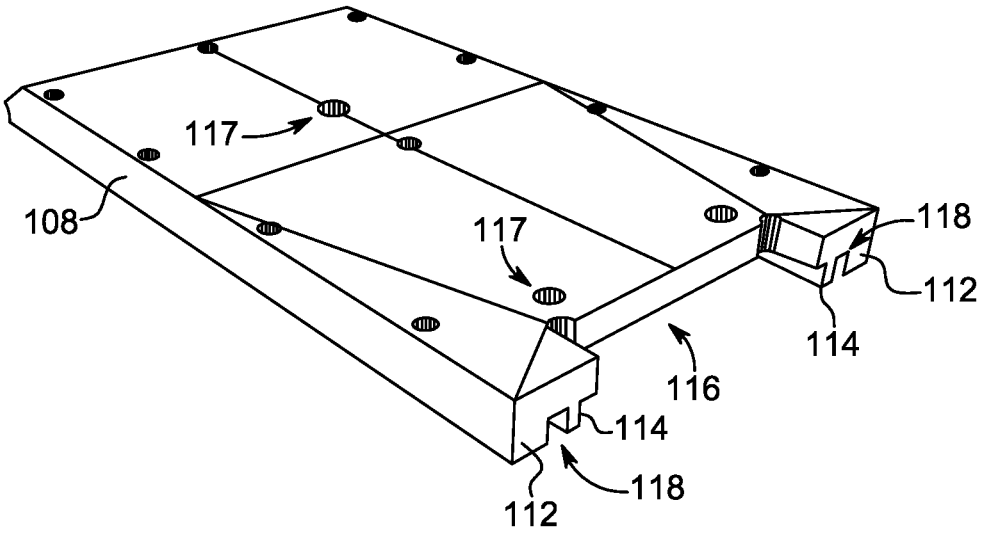
FIG. 25 shows another three dimensional view of the cover plate of FIG. 24.
Figure 27:
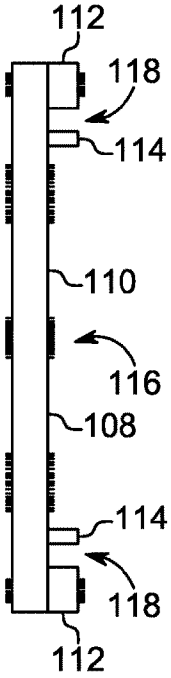
FIG. 27 shows a front end view of the cover plate of FIG. 24.
Figure 26:
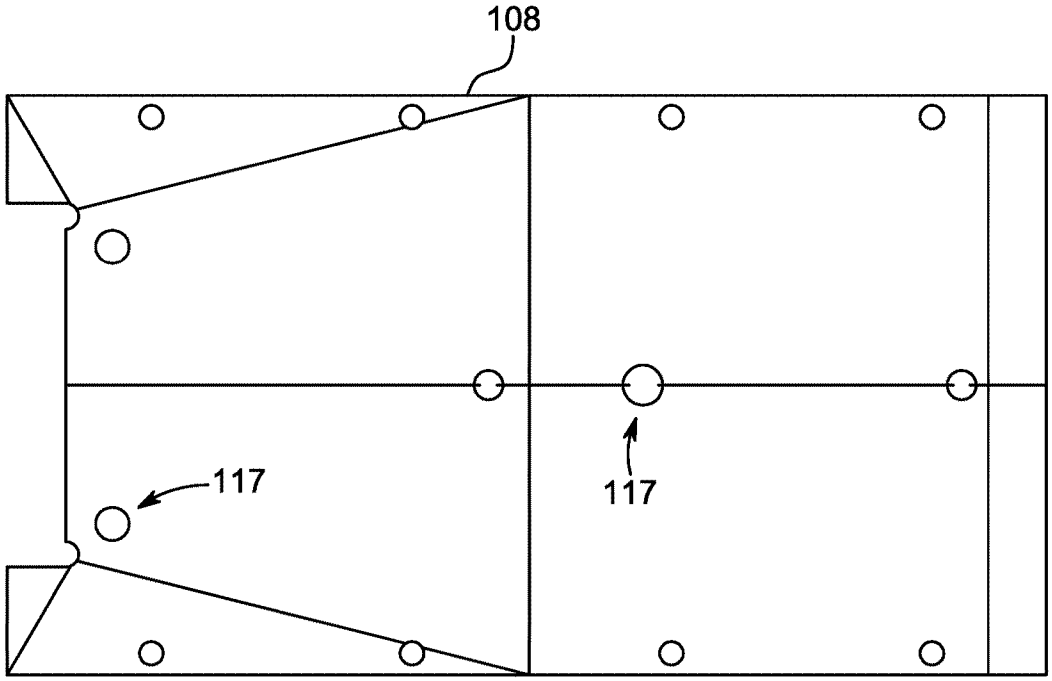
FIG. 26 shows a top plan view of the cover plate of FIG. 24.
Figure 28:
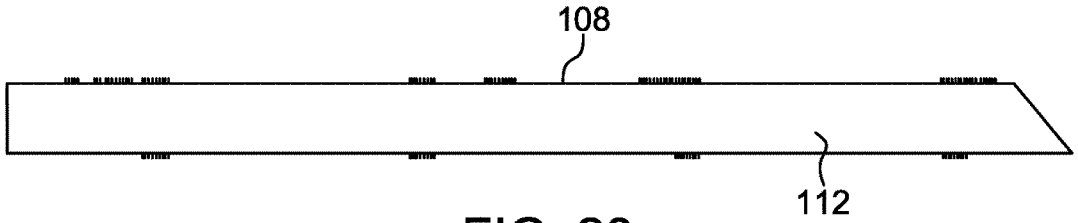
FIG. 28 shows a side view of the cover plate of FIG. 24.
Figure 32:
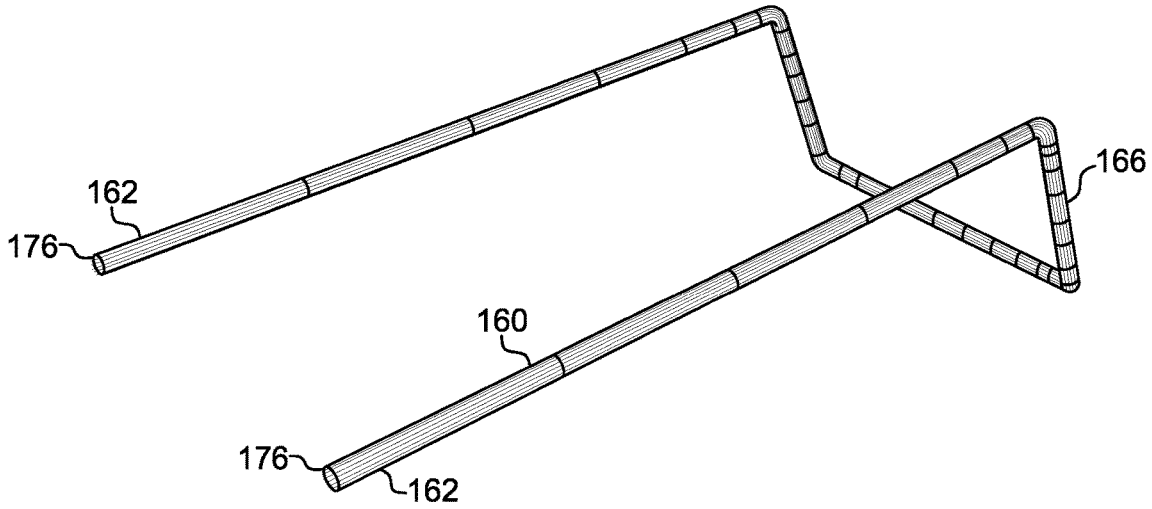
FIG. 32 shows a three-dimensional view of an exemplary embodiment of a safety pin for the accessory.

Fastening guns and the like usually have some form of safety mechanism that prevents firing unless an operative surface of the fastening gun is engaged with a workpiece. The accessory 10 includes a safety pin 160 (FIG. 32) that includes two opposed legs 162 that are received in respective external passages 118 (FIGS. 24, 25). A bridge member or bridge 166 interconnects proximal ends of the legs 162. The bridge 166 is shaped to accommodate a body of the fastening gun. More particularly, the bridge 166 is bent generally orthogonally with respect to the legs 162. The proximal end 139 of the guide plate 102 defines a pair of opposed recesses 95 to accommodate the bridge 166.

Figure 33:
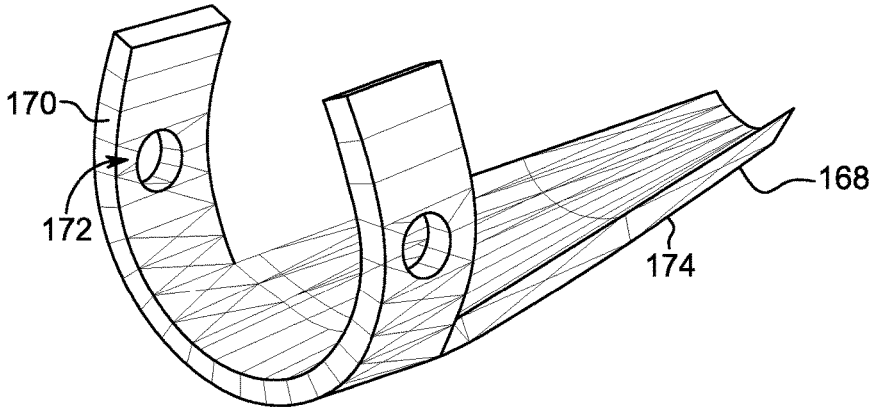
FIG. 33 shows a three-dimensional view of an exemplary embodiment of a connector for connecting the safety pin with a safety mechanism of the fastening gun.

A safety connector 168, shown in FIG. 33, is pivotally connected to the bridge 166 and to a safety mechanism or a trigger mechanism of the fastening gun. The safety connector 168 can have any number of different configurations, depending on the nature of the fastening gun with which it is to be used.

The safety connector 168 has a connecting formation 170 that defines a pair of openings 172, for example, through which the bridge 166 is received. A lug 174 is connected to the formation 170 and is configured to engage the safety mechanism of the fastening gun. It is to be appreciated that the safety connector 168 will have a configuration that is dependent on the safety mechanism of the fastening gun. Thus, the inventor(s) envisages that the safety connector 168 can have a number of different shapes, if necessary.

In some cases, it may be necessary to have a magazine that is of a length that would cause it to impinge on the fastening gun. In such cases, the adapter 138 is configured so that the magazine extends past the fastening gun. See, for example, FIG. 51.

Figure 11:
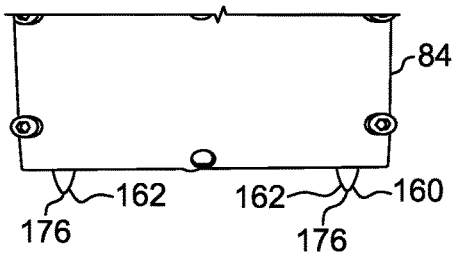
FIG. 11 shows a discharge end of an exemplary embodiment of a drive member guide assembly for the accessory.
Figure 9A:
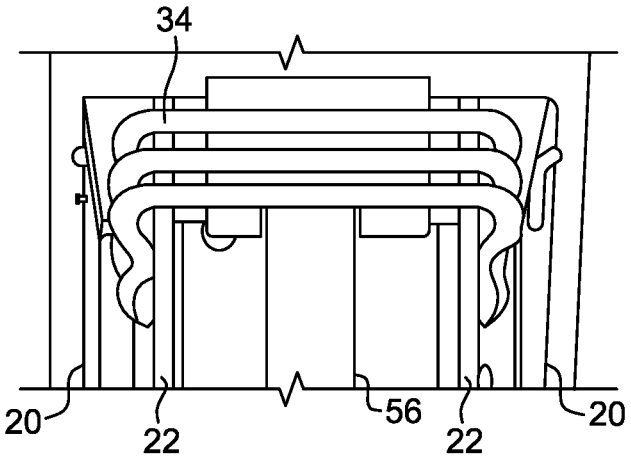
Figure 10A:
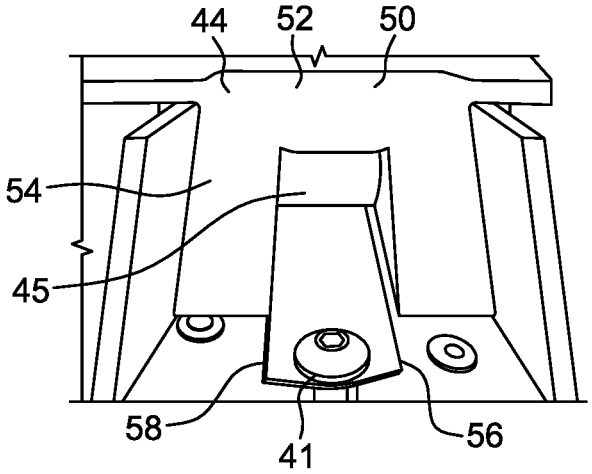

The legs 162 are dimensioned so that distal ends 176 (FIG. 11) of the legs 162 protrude from the respective passages 164 to engage a workpiece when the guide assembly 84 is pressed against the workpiece. This causes the safety pin 160 to be displaced towards the gun and to release the safety mechanism of the gun, via the safety connector 168.

A biasing mechanism is provided to bias the safety pin 160 into a position in which the safety mechanism of the fastening gun is operable. In other words, the safety pin 160 is biased into the condition or position shown in FIG. 11.

Figure 51:
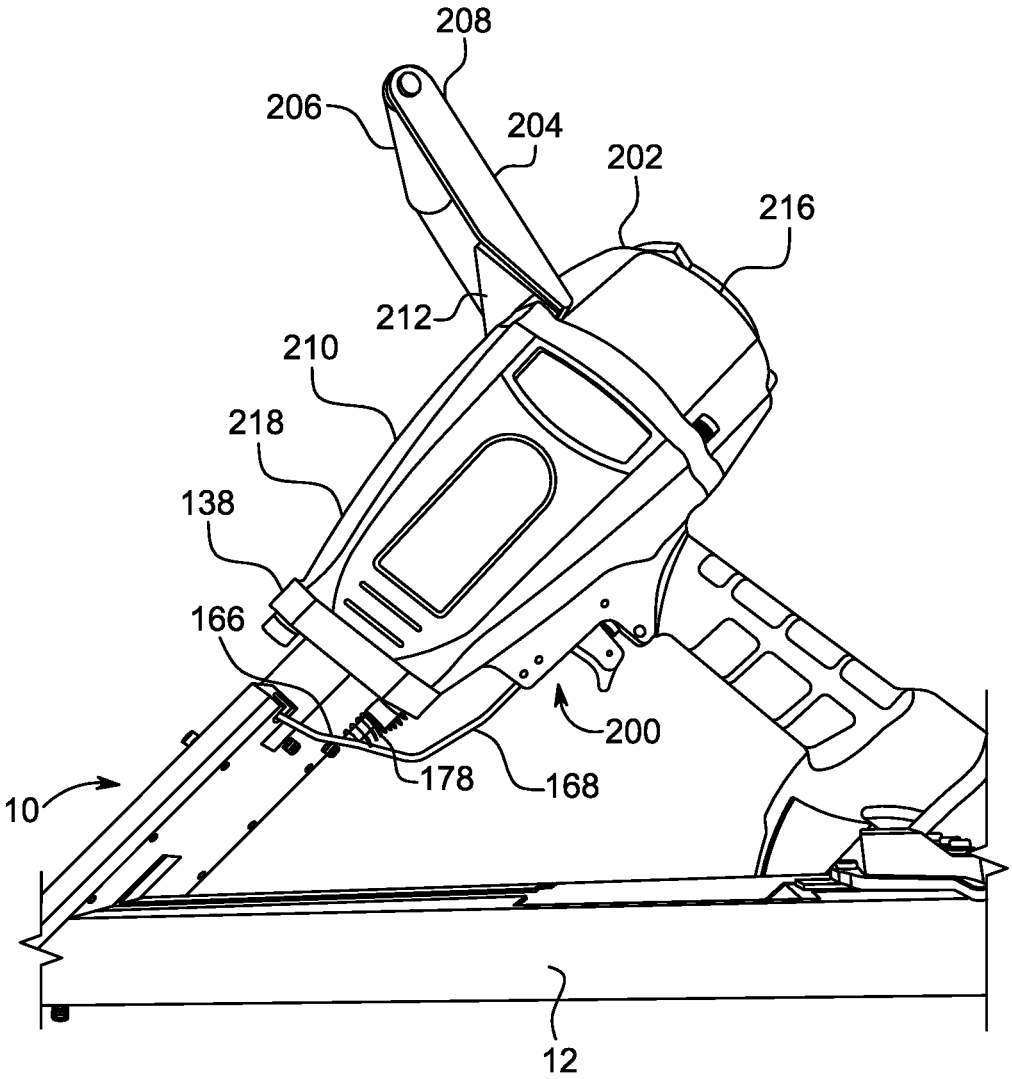
FIG. 51 shows an assembled view of the fastening gun and the accessory of FIG. 50.

The biasing mechanism includes a compression spring 178 that is interposed between the bridge 166 and the adaptor 138 (FIG. 51).

When the gun is triggered, the drive member is driven towards the workpiece, guided in the internal passage 116. The crown engaging surface 90 engages the crown 38 of a foremost staple 34 and drives the legs 36 into the workpiece.

Figure 45:
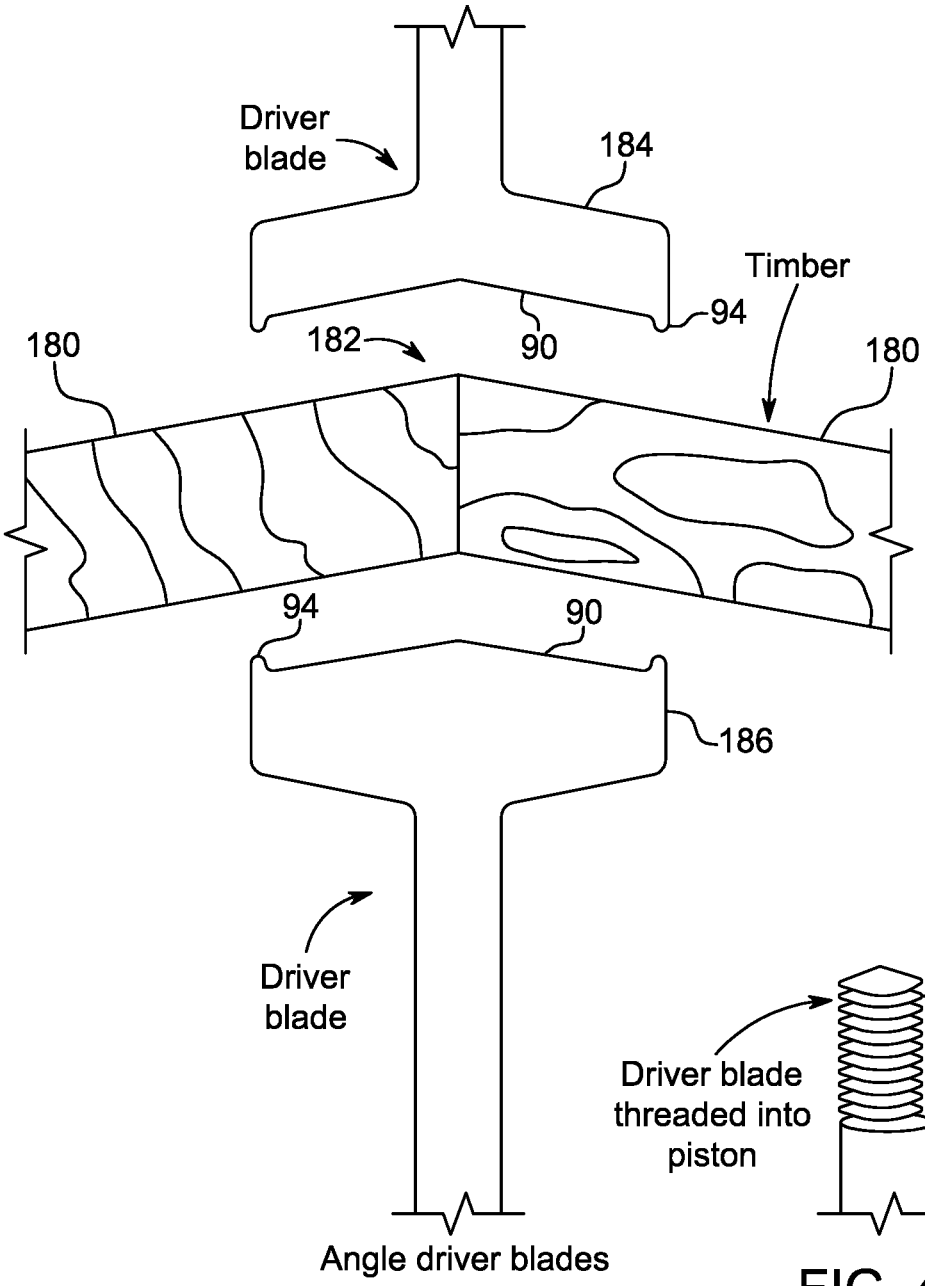
FIG. 45 shows a manner of operation of two exemplary embodiments of a drive member for use with the accessory.
Figure 46:
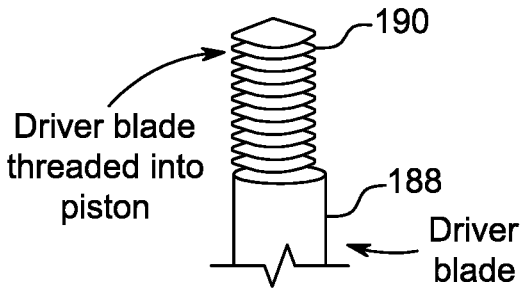
FIG. 46 shows a free end of a shank of an exemplary embodiment of a drive member, threaded for engagement with a piston of the fastening gun.

The accessory 10 is useful for fastening truss members 180 together, as shown in FIG. 45. It is known that ends of truss members are mitred so that the truss can define a peak or apex 182. Thus, when using the staples 34 to connect the truss members 180, it is necessary to drive each leg 36 into a respective truss member 180. The accessory 10 can be provided with two forms of drive member. One can have a driver blade 184 for driving staples 34 into outer surfaces of the truss members 180 and a driver blade 186 for driving staples 34 into inner surfaces of the truss members 180.

Thus, the crown engaging surface 90 of the driver blade 184 defines an included angle that corresponds generally with an excluded angle defined by the truss members 180 when joined together.

In contrast, the driver blade 186 has a crown engaging surface 90 that defines an excluded angle that corresponds generally with an included angle defined by the truss members 180 when joined together.

In this example, the driver blades 184, 186 have a shank 188 that defines a threaded portion 190 at a free end to allow the shank to be threaded directly into a piston of the gun.

Figure 42:
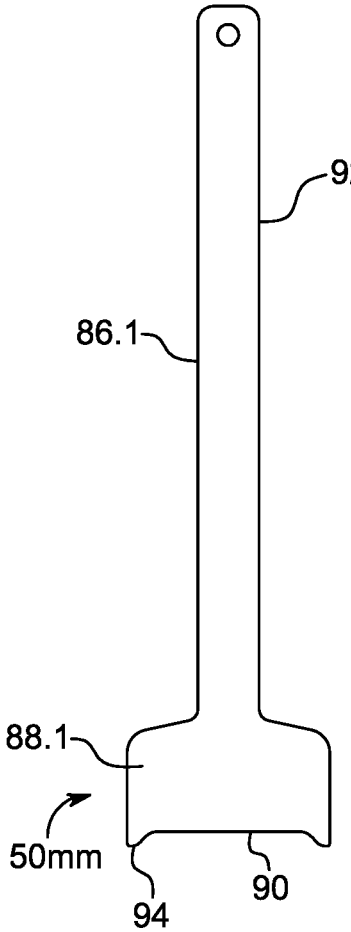
FIG. 42 shows a plan view of an exemplary embodiment of a staple drive member for use with the accessory.
Figure 43:
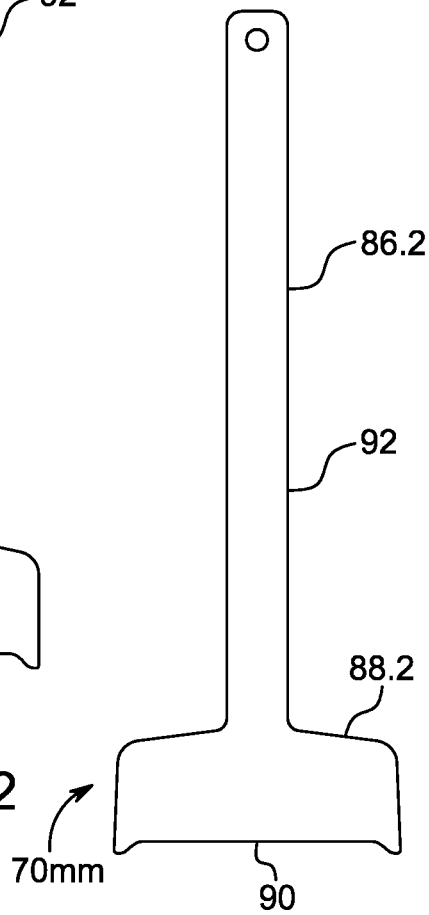
FIG. 43 shows a plan view of an exemplary embodiment of a staple drive member for use with the accessory.
Figure 44:
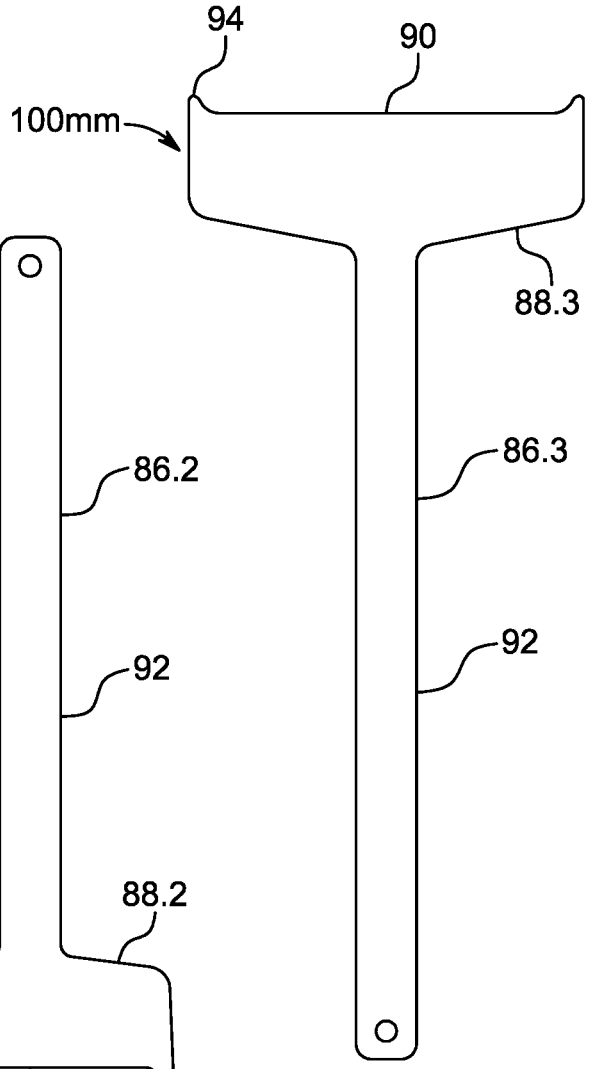
FIG. 44 shows a plan view of an exemplary embodiment of a staple drive member for use with the accessory.

The accessory 10 can be supplied with a number of different forms of drive member. For example, FIGS. 42 to 44 show three different forms of drive member 86. These are provided for differently sized staples. For example, the drive member 86.1 has a head 88.1 that is suited for a staple having a crown with a length of about 50 mm. The drive member 86.2 has a head 88.2 suited for a staple having a crown with a length of about 70 mm. The drive member 86.3 has a head 88.3 suited for a staple having a crown with a length of about 100 mm.

Figure 48:
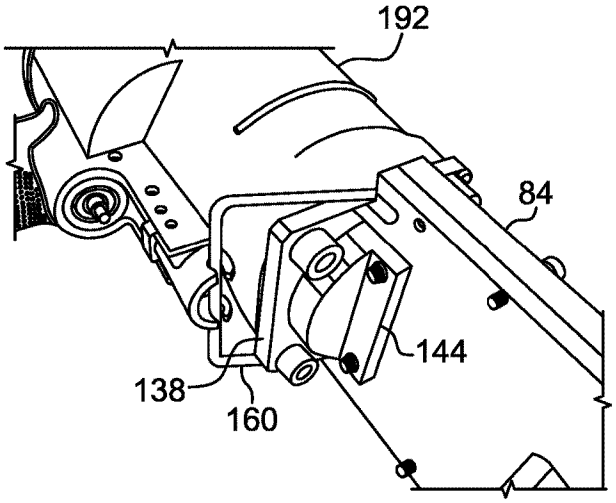
FIG. 48 shows a further view of the accessory connected to the fastening gun.
Figure 47:
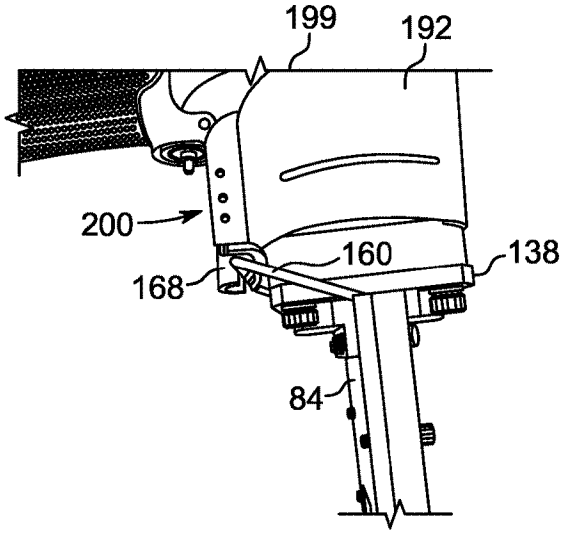
FIG. 47 shows a side view of an exemplary embodiment of the accessory, connected to a fastening gun.
Figure 49:
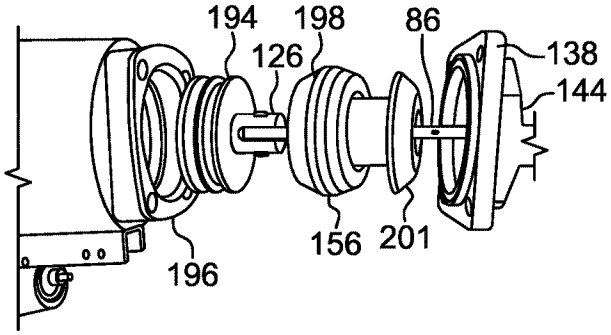
FIG. 49 shows a disassembled view of part of the accessory and the fastening gun.

FIGS. 47 to 49 illustrate further the manner in which the accessory 10 is mounted on a fastening gun, in this embodiment, referenced with 192. The fastening gun 192 has a pneumatic piston 194 that is mounted in a barrel 196. As can be seen in FIG. 40, the connector 126 is screwed into the piston 194.

The rubber bush or stopper arrangement 156 is interposed between the piston 194 and the adaptor 138. The bush 156 serves to facilitate retraction of the drive member and also protects the adaptor 138 and drive member by absorbing impact. The shank 86 of the drive member 180 extends through the adapter 138 and the bush 156, as can be seen.

The stopper arrangement 156 includes a bellows-like structure 198 and a piston-like structure 201 that extends from the structure 198. In this example, the stopper arrangement 156 is oriented so that the structure 201 is received in the adapter 138 while the structure 198 bears against the piston 194. Thus, as the piston 194 is driven towards the adapter 138, the structure 201 and the structure 198 are driven towards each other.

As can also be seen, the safety connector 168 is received in a housing 199 of the gun 192 to engage the safety mechanism indicated at 200. Engagement is in such a manner that displacement of the safety connector 168 as the safety pin 160 is pressed against the workpiece disengages the safety mechanism allowing operation of the gun 192.

Figure 50:
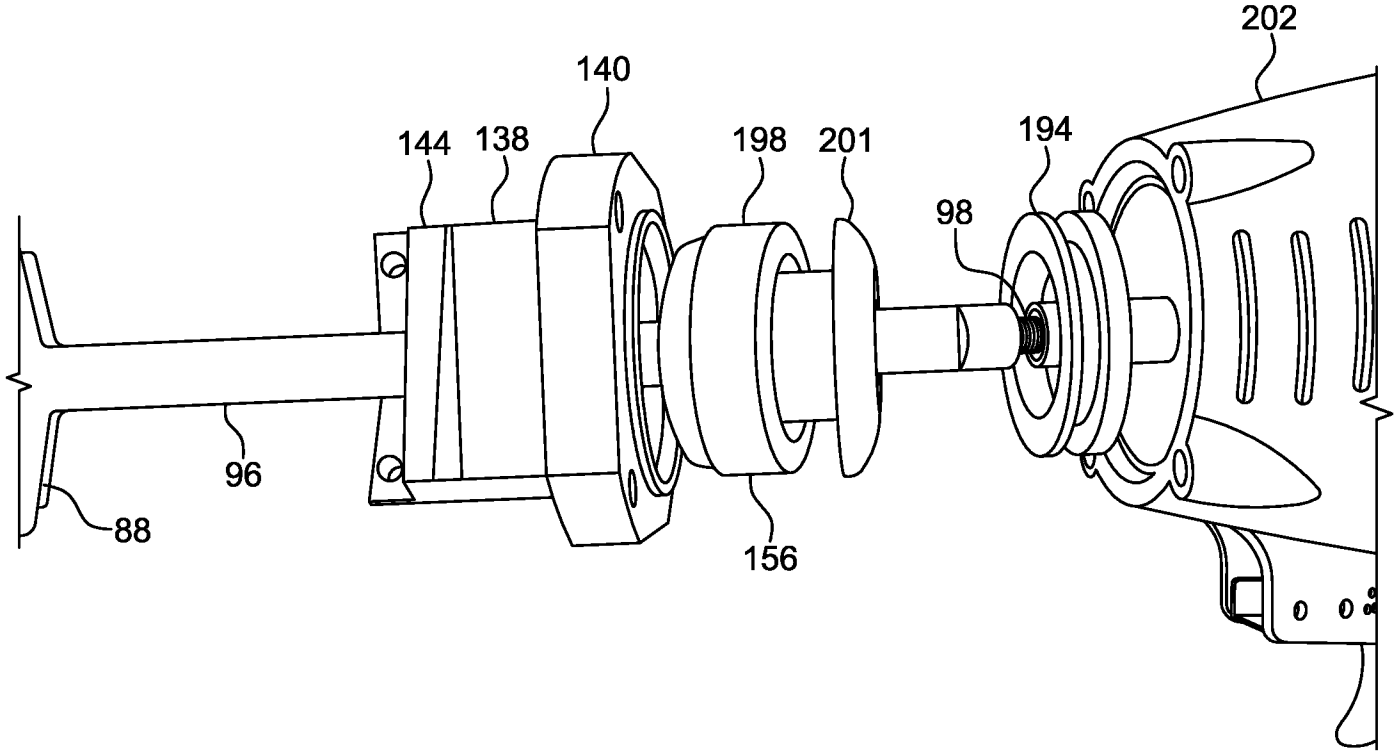
FIG. 50 shows a disassembled view of a further exemplary embodiment of a fastening gun and part of an accessory for the fastening gun

In FIG. 50, there is shown another example of a manner in which the accessory 10 is mounted on a fastening gun, in this example, referenced with 202. With reference to FIGS. 47 to 49, like reference numerals refer to like parts, unless otherwise specified.

In this example, the drive member is in the form of a unitary one piece structure. An example of the drive member is shown in FIGS. 37 to 39. In this example, the drive member is screwed directly into the piston 194. Also in this example, an orientation of the stopper arrangement 156 is reversed when compared with the assembly shown in FIGS. 37 to 39.

In FIG. 51, there is shown the accessory 10 connected to the gun 202. As can be seen, the safety connector 168 is connected to a safety mechanism 200 of the gun 202. As described above, as the safety pin 160 engages a workpiece, the safety mechanism 200 is disengaged allowing the gun 202 to be fired.

Figure 55:
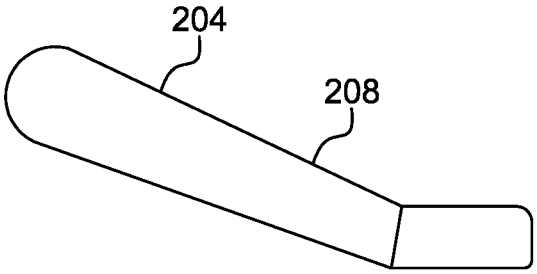
FIG. 55 shows a side view of a handle for the fastening gun.
Figure 56:
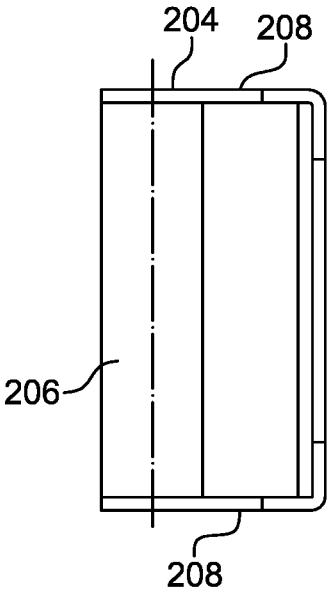
FIG. 56 shows a front view of the handle.
Figure 57:
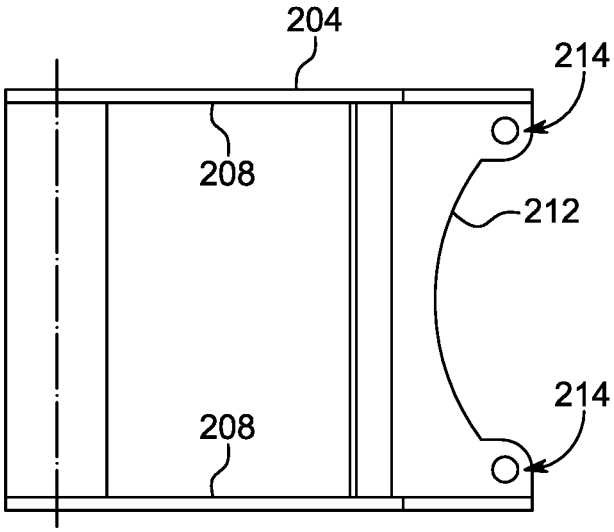
FIG. 57 shows a plan view of the handle.

In FIG. 51, there is shown a handle 204 connected to the gun 202. The handle 204 includes a handgrip 206 and a pair of legs 208, each leg 208 extending from a respective end of the handgrip 206. Detail of the handle 204 can be seen in FIGS. 55 to 57.

The legs 208 are configured to be fastened to a housing or casing assembly 210 of the gun 202. To that end, a bridge member 212 interconnects the legs 208. The bridge member 212 is recessed to accommodate a portion of the casing assembly so that the bridge member 212 can nest with the casing assembly 210. The bridge member 212 defines a pair of openings 214 that corresponds with openings in a rear casing member 216 that is fastened to a front casing member 218 with fasteners, in a conventional manner. Thus, the bridge member 212 can be fastened to the rear casing member 216 with the fasteners used to fasten the rear and front casing members 216, 218 together.

The guide members 22, 24 can be of a material that is relatively light in weight compared to steel. For example, the guide members 22, 24 can be of aluminium or of an aluminium alloy. In contrast, the drive member can be of a high strength material, such as a suitable steel. Thus, it is desirable that discharge ends of the guide members 22, 24 can be protected from wear which might result from the reciprocal movement of the drive member. To that end, a guide protection member 248 is mounted on the floor 24 of the inner guide member 22. Detail of the manner in which the guide protection member 248 is assembled, as shown in FIGS. 9 and 10. Detail of the guide protection member 248, itself, is shown in FIGS. 20 to 23.

The guide protection member 248 has a pair of legs 250 that depend from respective ends of a cross member 252. A foot 254 extends inwardly from respective ends of the legs 250. The cross member 252, the feet 254 and the legs 250 define a wear surface 256. The feet 254 are fastened to the floor 24 with suitable fasteners such as screws 258. The legs 250 and the feet 254 are oriented with respect to each other so that the wear surface 256 and the discharge ends 42 of the inner and outer guide members 22, 20 are generally coplanar.

The guide protection member 248 is of steel or a metal with similar wear properties. Thus, the guide protection member 248 can protect the guide members 22, 24 from wear.

The inventor has identified a particular problem associated with the use of fastening guns. This problem is referred to as "nail strike". This can occur when nails or staples are driven into respective opposite sides of a workpiece and one of the nails or staples strikes another nail or staple. This can have a significant effect on joint strength and often causes splitting of timber.

Figure 52:
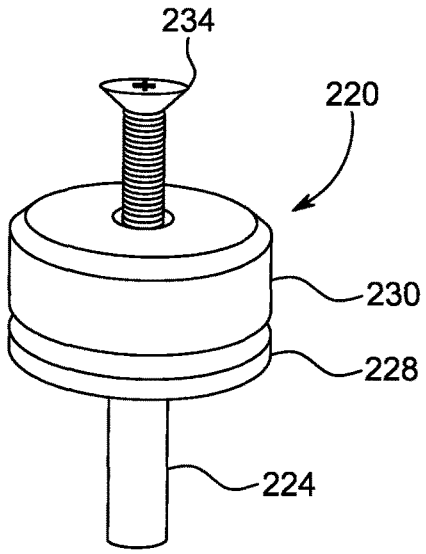
FIG. 52 shows an exemplary embodiment of an alignment pin assembly for the accessory.
Figure 53:
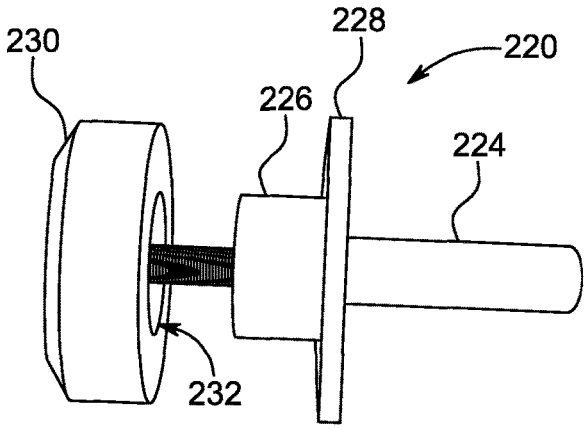
FIG. 53 shows another view of the alignment pin assembly.
Figure 54:
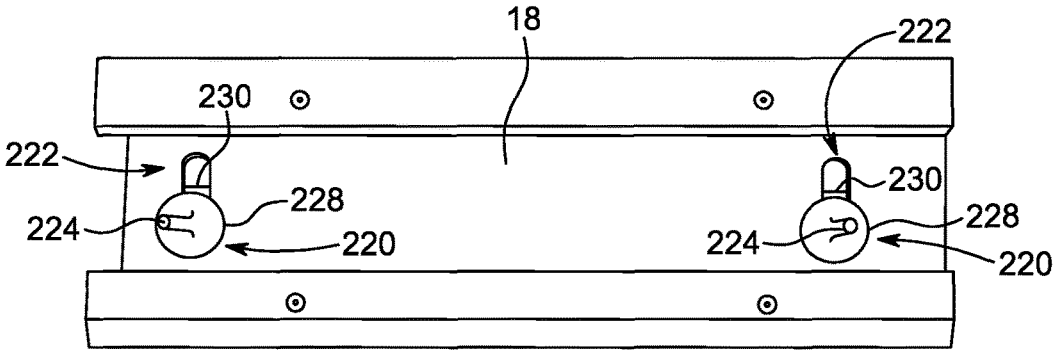
FIG. 54 shows a view from underneath of the magazine assembly fitted with two of the alignment pin assemblies of FIGS. 52 and 53.

In order to address this issue, the accessory 10 can include a pair of guide pin assemblies 220 (FIGS. 52 to 54). The floor 18 defines a pair of spaced lateral slots 222. Each guide pin assembly 220 includes a guide pin 224 and a head 226 arranged at one end of the guide pin 224. A flange 228 is interposed between the head 226 and the guide pin 224. The head 226 is dimensioned to fit through an associated slot 222 with a flange 228 bearing against an underneath surface 210 of the floor 18.

Each guide pin assembly 220 includes a cylindrical retainer 230 that can be received in the central channel 30. The cylindrical retainers 230 each define a socket 232 in which a respective head 226 can be received. Each head 226 has a threaded socket to receive a fastener 234 that extends through the associated retainer 230. Thus, when the fastener 234 is loosened, a lateral position of the associated guide pin 224 can be adjusted. Once adjusted, the fastener 234 can be tightened so that the floor 18 is sandwiched tightly between the flange 228 and the retainer 230.

In use, the guide pins 224 can be offset with respect to each other. The spacing between the guide pins 224 is selected so that when a fastening operation is carried out, a workpiece can be received between the guide pins 224 when the gun is operated from one side of the workpiece. Thus, when the operator engages the workpiece from an opposite side, also with the workpiece between the guide pins 224, the orientation of the gun is such that nail strike is avoided.

FIGS. 1 to 4 show an embodiment that includes guide pins 236 that are of sufficient diameter that lateral adjustment is unnecessary. It follows that the lateral slots together with the fastening arrangement described above are not required. In this case, the guide pins 236 are generally longitudinally aligned and spaced so that they can be used in the manner described above.

For example, the guide pins 236 can be configured so that when the accessory 10 is used to connect truss members, and the gun is moved from one side of a truss to the other side, there is a separation of about 6 mm at the point of entry of the staples on each side of the truss and the top plate to which the truss is being fixed.

As a result, use of the guide pin assemblies 220 or the guide pins 236 can eliminate "nail strike" when inserting nails or staples from opposite sides of a workpiece. This can be achieved without having carefully to align the gun to ensure that the trajectory or path of the nail or staple does not intersect with a previously set nail or staple. It will be appreciated that this can result in a significant saving of time and can avoid the problems associated with nail strike as mentioned above.

It will be appreciated that there is disclosed a fastening gun that incorporates the guide pin assemblies 220 or the guide pins 236.

Figure 58:
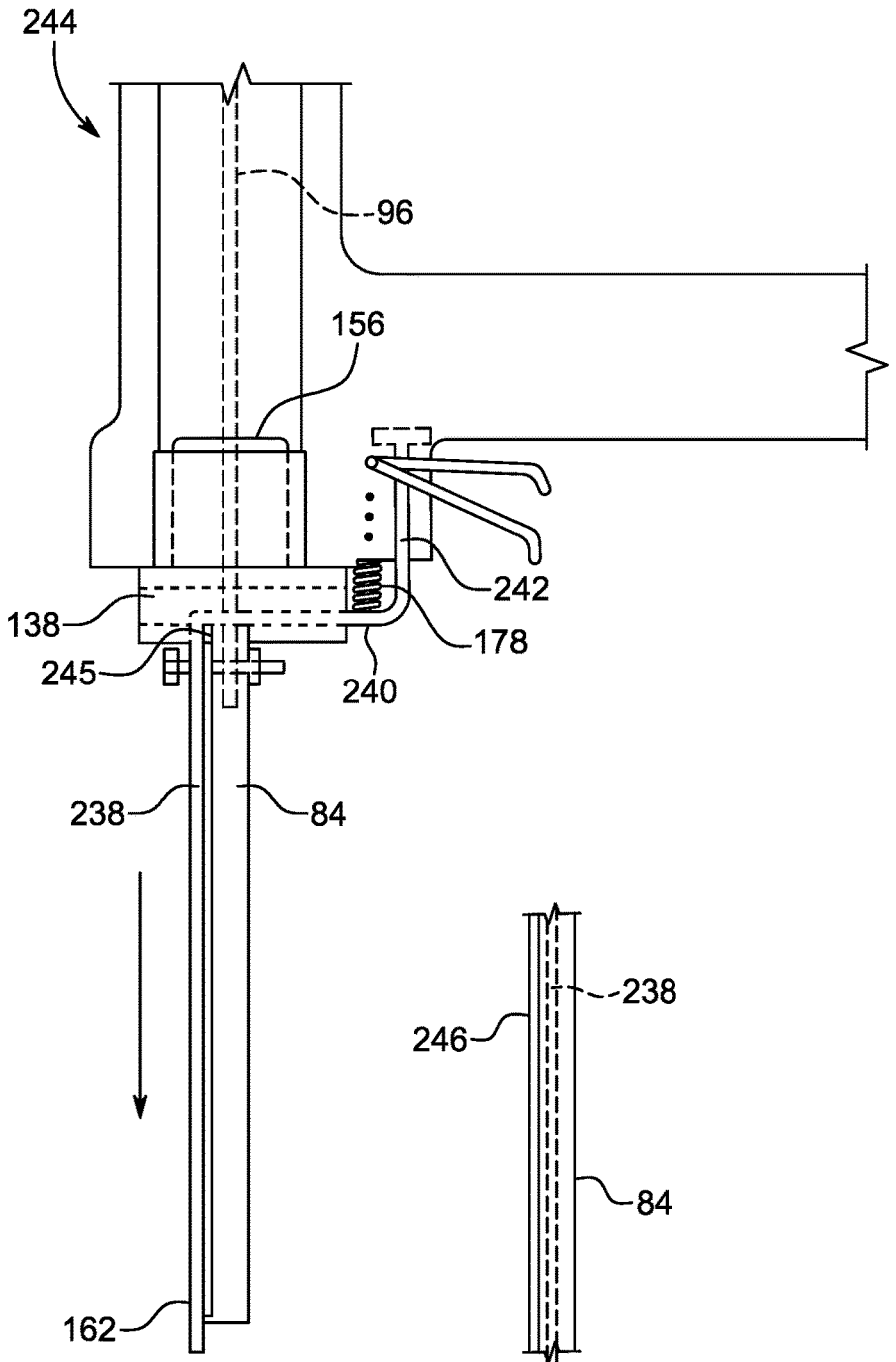
FIG. 58 shows a schematic side view of an alternative arrangement of a safety bar or safety pin for the accessory.
Figure 59:
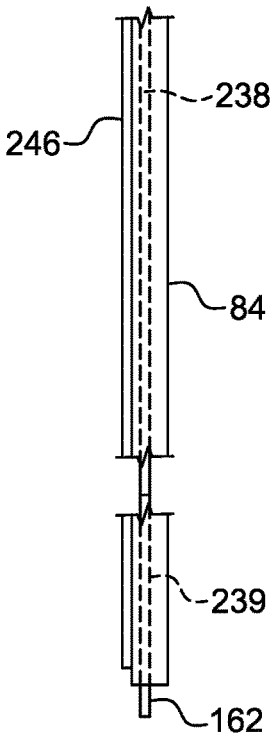
FIG. 59 shows a further schematic side view of the alternative arrangement.

In FIGS. 58 and 59, there is shown an alternative arrangement for a safety pin or safety bar 238. With reference to the preceding drawings, like reference numerals refer to like parts, unless otherwise specified.

In this example, the safety bar 238 is mounted on the guide assembly 84 so that the two opposed legs 162 extend in a plane that is spaced forwardly of a plane in which the drive member operates. This is in contrast to the previous example in which the safety pin 160 operates in a plane that is generally common with the plane of the drive member.

Thus, the safety bar 238 is mounted so that the legs 162 are positioned in front of the guide assembly 84. The guide assembly 84 can include a rebate 239 to accommodate the legs 162 (FIG. 59). A faceplate 246 can be fastened to the guide assembly 84 to cover the legs 162.

In this example, the bridge 166 is shaped to define an end portion 240 that engages a trigger safety bar 242 of the gun, indicated at 244.

The end portion 240 is bent over an upper end 245 of the guide assembly 84 and accommodates the adapter 138.

Throughout the specification, including the claims, where the context permits, the following words and phrases are defined as follows:

a. "Comprise" and variants and derivatives thereof are to be interpreted as including the stated integer or integers without necessarily excluding any other integers.
b. Words that indicate orientation or direction of travel are not to be considered limiting. Thus, words such as "front", "back", "rear", "side", "up", down", "upper", "lower", "top", "bottom", "forwards", "backwards", "towards", "distal", "proximal" and synonyms, antonyms and derivatives thereof have been selected for convenience only.

It is to be understood that the terminology employed above is for the purpose of description and should not be regarded as limiting. The described embodiments, are intended to be illustrative of the invention, without limiting the scope thereof. The invention is capable of being practised with various modifications and additions as will readily occur to those skilled in the art.

Various substantially and specifically practical and useful exemplary embodiments of the claimed subject matter, are described herein, textually and/or graphically, including the best mode, if any, known to the inventors for carrying out the claimed subject matter. Variations (e.g., modifications and/or enhancements) of one or more embodiments described herein might become apparent to those of ordinary skill in the art upon reading this application. The inventors expect skilled artisans to employ such variations as appropriate, and the inventors intend for the claimed subject matter to be practiced other than as specifically described herein. Accordingly, as permitted by law, the claimed subject matter includes and covers all equivalents of the claimed subject matter and all improvements to the claimed subject matter. Moreover, every combination of the above described elements, activities, and all possible variations thereof are encompassed by the claimed subject matter unless otherwise clearly indicated herein, clearly and specifically disclaimed, or otherwise clearly contradicted by context.

The use of any and all examples, or exemplary language (e.g., "such as") provided herein, is intended merely to better illuminate one or more embodiments and does not pose a limitation on the scope of any claimed subject matter unless otherwise stated. No language in the specification should be construed as indicating any non-claimed subject matter as essential to the practice of the claimed subject matter.

Thus, regardless of the content of any portion (e.g., title, field, background, summary, description, abstract, drawing figure, etc.) of this application, unless clearly specified to the contrary, such as via explicit definition, assertion, or argument, or clearly contradicted by context, with respect to any claim, whether of this application and/or any claim of any application claiming priority hereto, and whether originally presented or otherwise:

a. there is no requirement for the inclusion of any particular described or illustrated characteristic, function, activity, or element, any particular sequence of activities, or any particular interrelationship of elements;
b. no characteristic, function, activity, or element is "essential";
c. any elements can be integrated, segregated, and/or duplicated;

d. any activity can be repeated, any activity can be performed by multiple entities, and/or any activity can be performed in multiple jurisdictions; and e. any activity or element can be specifically excluded, the sequence of activities can vary, and/or the interrelationship of elements can vary.

The use of the terms "a", "an", "said", "the", and/or similar referents in the context of describing various embodiments (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted.

Moreover, when any number or range is described herein, unless clearly stated otherwise, that number or range is approximate. Recitation of ranges of values herein are merely intended to serve as a shorthand method of referring individually to each separate value falling within the range, unless otherwise indicated herein, and each separate value and each separate subrange defined by such separate values is incorporated into the specification as if it were individually recited herein. For example, if a range of 1 to 10 is described, that range includes all values therebetween, such as for example, 1.1, 2.5, 3.335, 5, 6.179, 8.9999, etc., and includes all subranges therebetween, such as for example, 1 to 3.65, 2.8 to 8.14, 1.93 to 9, etc.

Accordingly, every portion (e.g., title, field, background, summary, description, abstract, drawing figure, etc.) of this application, other than the claims themselves, is to be regarded as illustrative in nature, and not as restrictive, and the scope of subject matter protected by any patent that issues based on this application is defined only by the claims of that patent.

The invention claimed is:

1. An accessory for a fastening gun for discharging staples and wherein each staple comprises a crown and a leg on each side of the crown, the accessory comprising:

a magazine assembly with a feed end and a discharge end and configured to support a series of staples in a pre-discharge orientation and with a feed mechanism for feeding the staples from the feed end to the discharge end;

a staple drive member, the staple drive member defining first and second opposed generally flat surfaces wherein said first generally flat surface is directed toward said magazine assembly, said staple drive member further having a head with a crown-engaging surface, the head including beveled edges opposite the crown-engaging surface and wherein said beveled edges connect said first and second opposed generally flat surfaces in a direction that is aligned with the legs of each staple in said magazine assembly and wherein an acute angle is formed between said beveled edges and said second opposed generally flat surface, and a shank extending from the head so that the staple driver member has a generally T-shaped appearance, said shank having a longitudinal axis in the direction of movement of said staple drive member and wherein said head is perpendicular to said longitudinal axis; and a drive member guide assembly including a guide plate, the guide plate fastened to an elongate outer guide member of the magazine assembly and a cover plate that is fastened to the guide plate, an inner surface of the cover plate and the guide plate defining an internal passage in which the head of the drive member can be displaced towards and away from a workpiece and the cover plate and guide plate being configured so that the internal passage also defines a guide path for the staples, once they are fed from a staple guide assembly;

wherein the drive member guide assembly is mounted on the magazine assembly and configured so that a staple drive member is mounted in the drive member guide assembly to be driven and retracted along a predetermined path with respect to the magazine assembly, so that, when driven, the staple drive member can engage a staple to drive legs of the staple into respective components, the drive member guide assembly being configured for mounting on the fastening gun with the staple drive member connected to a piston of the fastening gun.

2. The accessory as claimed in claim 1, in which the drive member guide assembly is configured to cooperate with the staple drive member having the head that is configured to bear against a crown of the staple and the shank that can be connected to a piston of the fastening gun.

3. The accessory as claimed in claim 2, in which the elongate outer guide member of the magazine assembly defines a pair of sidewalls, a floor interposed between the sidewalls and an inner guide member positioned on the floor between the sidewalls such that the guide members define a pair of outer channels and a central channel interposed between the outer channels.

4. The accessory as claimed in claim 3, in which a pair of roof members is arranged on respective sidewalls of the outer guide member and extend inwardly from the sidewalls to cover the outer channels at least partially, with said roof members defining a recess at or near a feed end of the drive member guide assembly so that staples can be fed into the drive guide assembly via the recesses.

5. The accessory as claimed in claim 4, in which discharge ends of the inner and outer guide members are located in a common plane that is angled towards the feed end from the floor.

6. The accessory as claimed in claim 3, in which the feed mechanism includes a tension block mounted in the outer and central channels, the tension block defining outer bearers received in respective outer channels and having bearing faces that are configured to bear against respective legs of the last staple in a row of the staples.

7. The accessory as claimed in claim 6, in which the tension block includes a cross member that interconnects the bearers to span the central channel, the cross member defining a central bearing face that is recessed with respect to the bearing faces and oriented in a plane generally parallel to said common plane of the discharge ends of the inner and outer guide members.

8. The accessory as claimed in claim 6, in which the tension block is spring mounted in the outer and central channels to be biased towards the discharge ends of the inner and outer guide members.

9. The accessory as claimed in claim 8, in which a catch assembly is mounted on the staple guide assembly to engage the tension block in a releasable manner when the tension block is in a pre-release condition.

10. The accessory as claimed in claim 1, in which the staple drive member has a locator positioned at each end of the crown-engaging surface to locate the crown of the staple with respect to the crown-engaging surface.

11. The accessory as claimed in claim 1, in which the staple drive member includes a connector fixed to a distal end of the shank so that the staple drive member can be connected to a piston of the fastening gun.

12. The accessory as claimed in claim 1, which includes an adapter so that the drive member guide assembly can be connected to the fastening gun.

13. The accessory as claimed in claim 1, which includes a safety pin assembly that is arranged with respect to the drive member guide assembly to be linearly displaceable with respect thereto, and that includes a safety pin that is configured to be displaceable between an extended position in which a portion of the safety pin extends beyond a distal end of the drive member guide assembly and a retracted position.

14. The accessory as claimed in claim 13, in which the safety pin assembly includes a safety connector that is capable of connection to both the safety pin and a safety mechanism of the fastening gun, the safety pin and the safety connector being configured so that when the safety pin moves from the extended position into the retracted position, the safety mechanism of the fastening gun is disengaged and the gun can fire.

15. The accessory as claimed in claim 1, in which the magazine assembly includes a base that is configured for bearing against a workpiece as the fastening gun is operated, a guide arrangement being arranged on the base and configured to guide the base against the workpiece such that the trajectory of a fastener ejected from the magazine and driven into the workpiece from one side of the workpiece is displaced from the trajectory of a fastener driven into the workpiece from an opposite side so that interference of the fasteners is inhibited.

16. The accessory as claimed in claim 15, in which the guide arrangement is in the form of a pair of pins that extends from the base, the pins may be positioned so that the workpiece can be received between the pins, the pins having a diameter which is sufficient to provide non-symmetrical orientation of the magazine with respect to the workpiece on opposite sides of the workpiece.

17. A fastening gun that includes the accessory as claimed in claim 1.

18. An accessory for a fastening gun for discharging staples and wherein each staple comprises a crown portion and a leg on each side of the crown portion, the accessory comprising:

a magazine assembly with a feed end and a discharge end and configured to support a series of staples in a pre-discharge orientation and with a feed mechanism for feeding the staples from the feed end to the discharge end;

a staple drive member, the staple drive member defining first and second opposed generally flat surfaces wherein said first generally flat surface is directed toward said magazine assembly, said staple driver member further comprising a head arranged orthogonally to a shank having a longitudinal axis in the direction of movement of said staple drive member and wherein said head is perpendicular to said longitudinal axis at a first end of said shaft in a T-shaped appearance, said head having an engagement surface for contacting a crown portion of each staple and wherein said shank extends from said head and comprises a second end, opposite said first end, which is configured for connecting to a piston of the fastening gun, said head further comprising beveled edges opposite said engagement surface, said beveled edges connecting said first and second opposed generally flat surfaces in a direction that is aligned with the legs of each staple in said magazine assembly and wherein an acute angle is formed between said beveled edges and said second opposed generally flat surface and inhibiting obstruction between said head and staples present in said magazine during retraction of said staple driving member;

a drive member guide assembly mounted on the magazine assembly and configured so that said staple drive member is mounted in the drive member guide assembly to be driven and retracted along a predetermined path with respect to the magazine assembly, so that, when driven, said staple drive member can engage a staple to drive legs of the staple into respective components, said drive member guide assembly being configured for mounting on the fastening gun with the staple drive member connected to a piston of the fastening gun.

* * * * *